US007489884B2

(12) United States Patent
Ichikawa et al.

(10) Patent No.: US 7,489,884 B2
(45) Date of Patent: Feb. 10, 2009

(54) IMAGE FORMING APPARATUS, CORRECTION PARAMETER SETTING DEVICE, AND DENSITY NON-UNIFORMITY CORRECTION DEVICE

(75) Inventors: Junichi Ichikawa, Kanagawa (JP); Hideki Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 477 days.

(21) Appl. No.: 11/446,400

(22) Filed: Jun. 5, 2006

(65) Prior Publication Data

US 2007/0116482 A1 May 24, 2007

(30) Foreign Application Priority Data

Nov. 22, 2005 (JP) ..... 2005-337644

(51) Int. Cl.
*G03G 15/00* (2006.01)
*G03G 15/043* (2006.01)

(52) U.S. Cl. ..... 399/49; 347/135; 347/253; 399/51

(58) Field of Classification Search ..... 399/49, 399/51, 60, 72; 347/131–133, 135, 246, 347/251–254

See application file for complete search history.

(56) References Cited

U.S. PATENT DOCUMENTS 6,049,690 A * 4/2000 Nakayasu et al. ..... 399/301
6,288,733 B1 * 9/2001 Nakazawa et al. ..... 347/133
6,658,221 B2 * 12/2003 Hama et al. ..... 399/49
6,750,892 B2 * 6/2004 Suzuki ..... 347/133
7,239,833 B2 * 7/2007 Tomita et al. ..... 399/299
7,382,387 B2 * 6/2008 Ichikawa et al. ..... 347/131

FOREIGN PATENT DOCUMENTS

JP 07036231 A * 2/1995
JP 08023445 A * 1/1996
JP A-10-020579 1/1998
JP 2005081581 A * 3/2005

* cited by examiner

*Primary Examiner*—Robert Beatty
(74) *Attorney, Agent, or Firm*—Morgan, Lewis & Bockius LLP

(57) ABSTRACT

An image forming apparatus includes a first submodule used for image formation; a first phase detector detecting a phase of the first submodule; a second submodule used for image formation with the first submodule; a second phase detector detecting a phase of the second submodule; a density detector detecting density of an image formed by the first and second submodules; a correction setting section setting a first and second parameters to correct density non-uniformity in a slow-scan direction caused by the first and second submodules, respectively, based on the detected image density data; an output setting section deriving a first correction value for the phase of the first submodule from the first parameter and a second correction value for the phase of the second submodule from the second parameter, and outputting a correction value generated by merging the first and second correction values; and an imaging condition changing section changing imaging conditions in accordance with the correction value.

19 Claims, 16 Drawing Sheets

IMAGE FORMING APPARATUS, CORRECTION PARAMETER SETTING DEVICE, AND DENSITY NON-UNIFORMITY CORRECTION DEVICE

This application claims the benefit of Japanese Patent Application No. 2005-337644 filed in Japan on Nov. 22, 2005, which is hereby incorporated by reference.

BACKGROUND

1. Technical Field

The present invention relates to an image forming apparatus such as electrophotographic copiers, printers, and facsimiles.

2. Related Art

Conventional image forming apparatus provided with plural submodules such as a photoconductor drum, a charging device, an exposure device, a developing device, and a transfer device is known. In this image forming apparatus, the rotating photoconductor drum is uniformly charged by the charging device. Then, the charged surface of the photoconductor drum is selectively illuminated with light by the exposure device, thereby an electrostatic latent image is formed on the photoconductor drum. After the electrostatic latent image formed on the photoconductor drum is developed into a visible image by the developing device, the thus produced toner image is transferred onto a recording material by the transfer device.

In this image forming apparatus, to suppress non-uniformity in the density of an image recorded, a toner image of a predetermined pattern is formed at predetermined timing and operating parameters of the submodules constituting the image forming apparatus are adjusted, based on results of detecting the density of the toner image of the predetermined pattern. These operating parameters may include, for example, a charging bias that is used by the charging device, the light quantity of a light beam that is emitted by the exposure device, a developing bias that is used by the developing device, the amount of toner supply, and output power of the transfer device.

In the image forming apparatus, certain tolerances are allowed for the photoconductor drum and a photoconductive layer formed on the drum. For this reason, even if the above operating parameters are set appropriately, non-uniformity in density may occur in the rotation direction of the photoconductor drum, or in other words, in a slow-scan direction. Besides the photoconductor drum, certain tolerances are allowed for, for example, a charging roller provided in the charging device, a developing roller provided in the developing device, and a transfer roller provided in the transfer device, respectively. Therefore, these submodules may be a possible source causing non-uniformity in density in the slow-scan direction during the formation of an image.

Especially, still higher image quality is required recently and there is a need to improve uniformity in density at a high level, which has not been acknowledged as a problem in the past. In short, non-uniformity in density in the slow-scan direction caused by these plural submodules is a new emerging problem.

SUMMARY

According to an aspect of the present invention, an image forming apparatus includes a first submodule that is used for image formation; a first phase detector that detects a phase of the first submodule; a second submodule that is used for image formation in conjunction with the first submodule; a second phase detector that detects a phase of the second submodule; a density detector that detects density of an image formed by using the first submodule and the second submodule; a correction setting section that sets a first parameter to correct non-uniformity in density in a slow-scan direction caused by the first submodule and a second parameter to correct non-uniformity in density in the slow-scan direction caused by the second submodule, based on image density data detected by the density detector; an output setting section that derives a first correction value for the phase of the first submodule detected by the first phase detector from the first parameter set by the correction setting section, derives a second correction value for the phase of the second submodule detected by the second phase detector from the second parameter set by the correction setting section, and outputs a correction value generated by merging the first correction value and the second correction value; and an imaging condition changing section that changes imaging conditions in accordance with the correction value which is output by the output setting section.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the accompanying drawings.

FIRST EXEMPLARY EMBODIMENT

Figure 1:
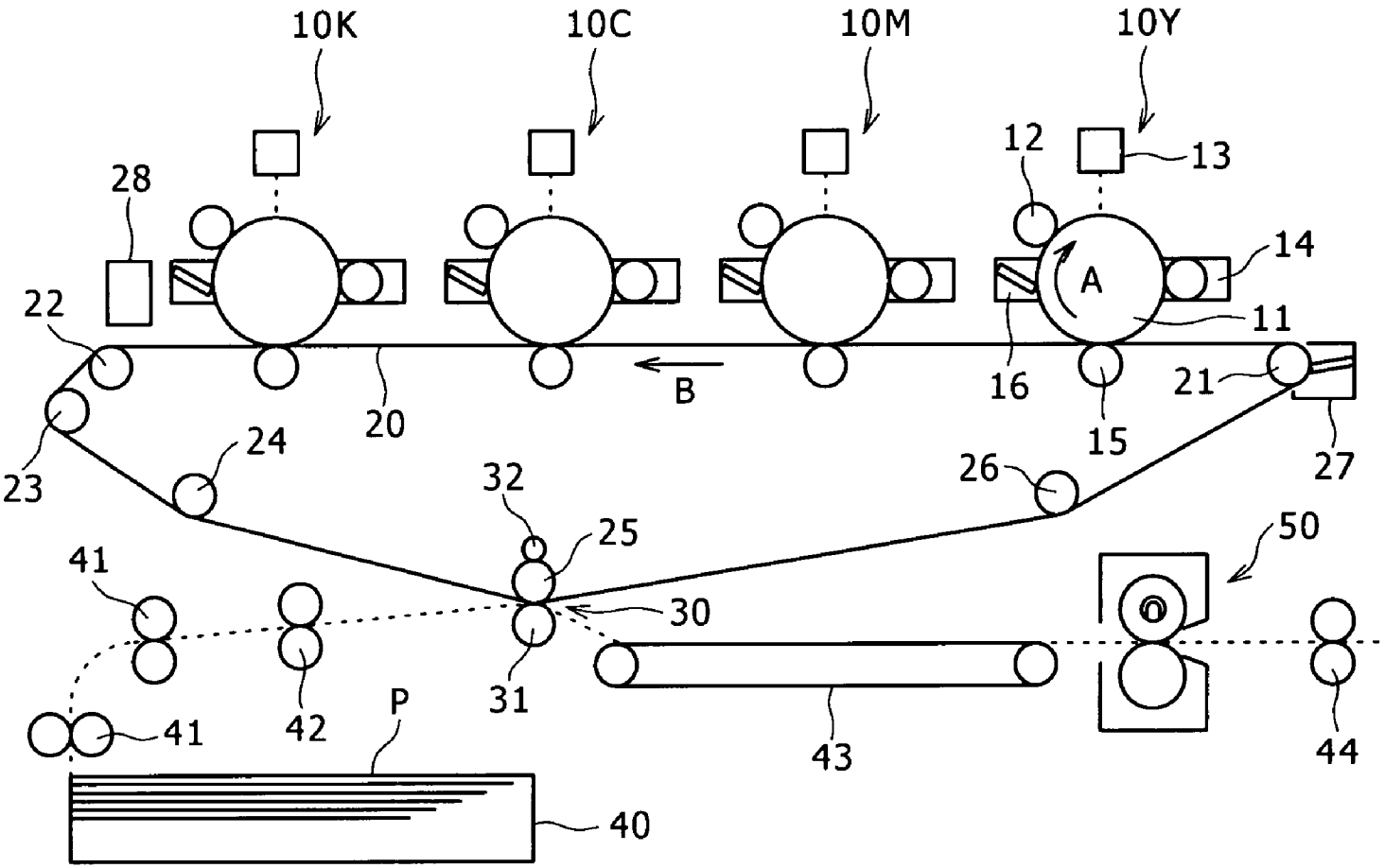
FIG. 1 is a diagram showing an overall configuration of an image forming apparatus according to an exemplary embodiment of the invention.

FIG. 1 is a diagram showing an overview of an image forming apparatus according to a first exemplary embodiment. This image forming apparatus includes plural (four in this exemplary embodiment) image forming units (specifically, 10Y, 10M, 10C, and 10K) by which toner images of color components are formed by, for example, an electrophotographic system. This image forming apparatus also includes an intermediate transfer belt 20 onto which the toner images of color components formed by image forming units 10 are transferred (first transfer) one after another and held. This image forming apparatus further includes a second transfer device 30 that transfers the overlapped images transferred onto the intermediate transfer belt 20 together onto a sheet of paper P (second transfer) at a time. This image forming apparatus still further includes a fixing device 50 that fixes the second-transferred image onto the paper P.

The image forming units (10Y, 10M, 10C, and 10K) have similar configurations except that they use different colors of toners. Then, taking an image forming unit 10K for black as an example, its configuration is described. The image forming unit 10K for black includes a photoconductive layer which is not shown and a photoconductor drum 11 which is installed rotatably in a direction of arrow A. Around this photoconductor drum 11, a charging roller 12, an exposure unit 13, a developing unit 14, a first transfer roller 15, and a drum cleaner 16 are installed. Among them, the charging roller 12 is placed rotatably in contact with the photoconductor drum 11 and charges the photoconductor drum 11 at a predetermined potential. Using a laser beam, the exposure unit 13 writes an electrostatic latent image onto the photoconductor drum 11 charged at a predetermined negative potential by the charging roller 12. The developing unit 14 contains a toner of the corresponding color component (a black toner in the case of the image forming unit 10K for black) and develops the electrostatic latent image on the photoconductor drum 11 by this toner. The first transfer roller 15 first-transfers the toner image formed on the photoconductor drum 11 onto the intermediate transfer belt 20. The drum cleaner 16 removes residues (such as the toner) from the surface of the photoconductor drum 11 after the first transfer.

The intermediate transfer belt 20 is supported by plural supporting rollers (six in this exemplary embodiment) so as to be rotatable and tightly stretched. Among these supporting rollers, a driving roller 21 drives and rotates the intermediate transfer belt 20, while supporting it in a tightly stretched state. Driven rollers 22, 23, 26 rotate driven by the intermediate transfer belt 20 that is driven by the driving roller 21, while supporting the intermediate transfer belt 20 in a tightly stretched state. A correction roller 24 functions as a steering roller (which is placed tiltably on one end point in its axial direction as a supporting point) that restrains the belt from meandering motion in a direction approximately orthogonal to the forward direction of the intermediate transfer belt 20, while supporting it in a tightly stretched state. Moreover, a backup roller 25 functions as a constituent member of the second transfer device 30 which will be described later, while supporting the intermediate transfer belt 20 in a tightly stretched state.

A belt cleaner 27 that removes residues (such as the toners) from the intermediate transfer belt 20 after the second transfer is installed in a position facing the driving roller 21 across the intermediate transfer belt 20. A density sensor 28 as the density detector is installed so as to face the intermediate transfer belt 20. The density sensor 28 is located adjacent to the image forming unit 10K for black and detects the density of each color toner first-transferred onto the intermediate transfer belt 20.

The second transfer device 30 includes a second transfer roller 31 which is placed, pressed against the surface carrying a toner image of the intermediate transfer belt 20 and the backup roller 25 which forms an electrode opposite to the second transfer roller 31, placed on the rear surface of the intermediate transfer belt 20. A power feed roller 32 that applies a second transfer bias of the same polarity as the toner charging polarity is placed abutting on this backup roller 25. On the other hand, the second transfer roller 31 is grounded.

A paper transport system includes a paper tray 40, transport rollers 41, registration rollers 42, a transport belt 43, and ejection rollers 44. In the paper transport system, after a sheet of paper P stacked in the paper tray 40 is transported by the transport rollers 41, it is once stopped at the registration rollers 42 and then fed into a position for second transfer in the second transfer device 30 at certain timing. The sheet of paper P, after subjected to the second transfer, is transported on the transport belt 43 to the fixing device 50 and the sheet of paper P ejected from the fixing device 50 is sent out of the apparatus by the ejection rollers 44.

Next, an imaging process of this image forming apparatus is described. When a start switch outside the structure shown is turned on, a predefined imaging process is executed. Specifically, for example, in the case where this image forming apparatus is configured as a digital color copier, an original that is set on a platen not shown is fast-scanned by a color image scanner. Then, by a processing circuit, the acquired scan signals are converted into digital image signals which are temporarily stored in a memory. Based on the digital image signals for four colors (Y, M, C, K) stored in the memory, toner images of these colors are formed. That is, each of the image forming units (specifically, 10K, 10Y, 10M, and 10C) are driven in accordance with the digital image signals of each color. Next, in each image forming unit 10, the exposure unit 13 illuminates the photoconductor drum 11 uniformly charged by the charging roller 12 with the laser beam corresponding to the digital image signals, thereby forming an electrostatic latent image. The electrostatic latent image formed on the photoconductor drum 11 is developed by the developing unit 14 and a toner image of each color is formed. If this image forming apparatus is configured as a printer, toner images of each color may be formed, based on digital image signals input from an external device such as a personal computer.

Then, the toner images formed on the photoconductor drums 11 are sequentially first-transferred by the first transfer rollers 15 onto the surface of the intermediate transfer belt 20 in the first transfer positions where the photoconductor drums 11 come into contact with the intermediate transfer belt 20. At the same time, the toners remaining on the photoconductor drums 11 after the first transfer are cleared by the drum cleaners 16.

The thus first-transferred toner images onto the intermediate transfer belt 20 are overlapped together on the intermediate transfer belt 20 and transported to the second transfer position by the rotation of the intermediate transfer belt 20. At the same time, a sheet of paper P is transported to the secondary position at predetermined timing and the second transfer roller 31 nips the sheet of paper P against the backup roller 25.

By the action of an electric field for transfer developed between the second transfer roller 31 and the backup roller 25 in the second transfer position, a composite color toner image carried on the intermediate transfer belt 20 is second-transferred onto the sheet of paper P. The sheet of paper P having the toner image transferred to it is transported to the fixing device 50 by the transport belt 43. By applying heat and pressure, the fixing device 50 heats the toner image and pressure-fixes it onto the sheet of paper P which is then sent out to a catch tray (not shown) provided outside the apparatus. At the same time, the toners remaining on the intermediate transfer belt 20 after the second transfer are cleared by the belt cleaner 27.

Figure 2:
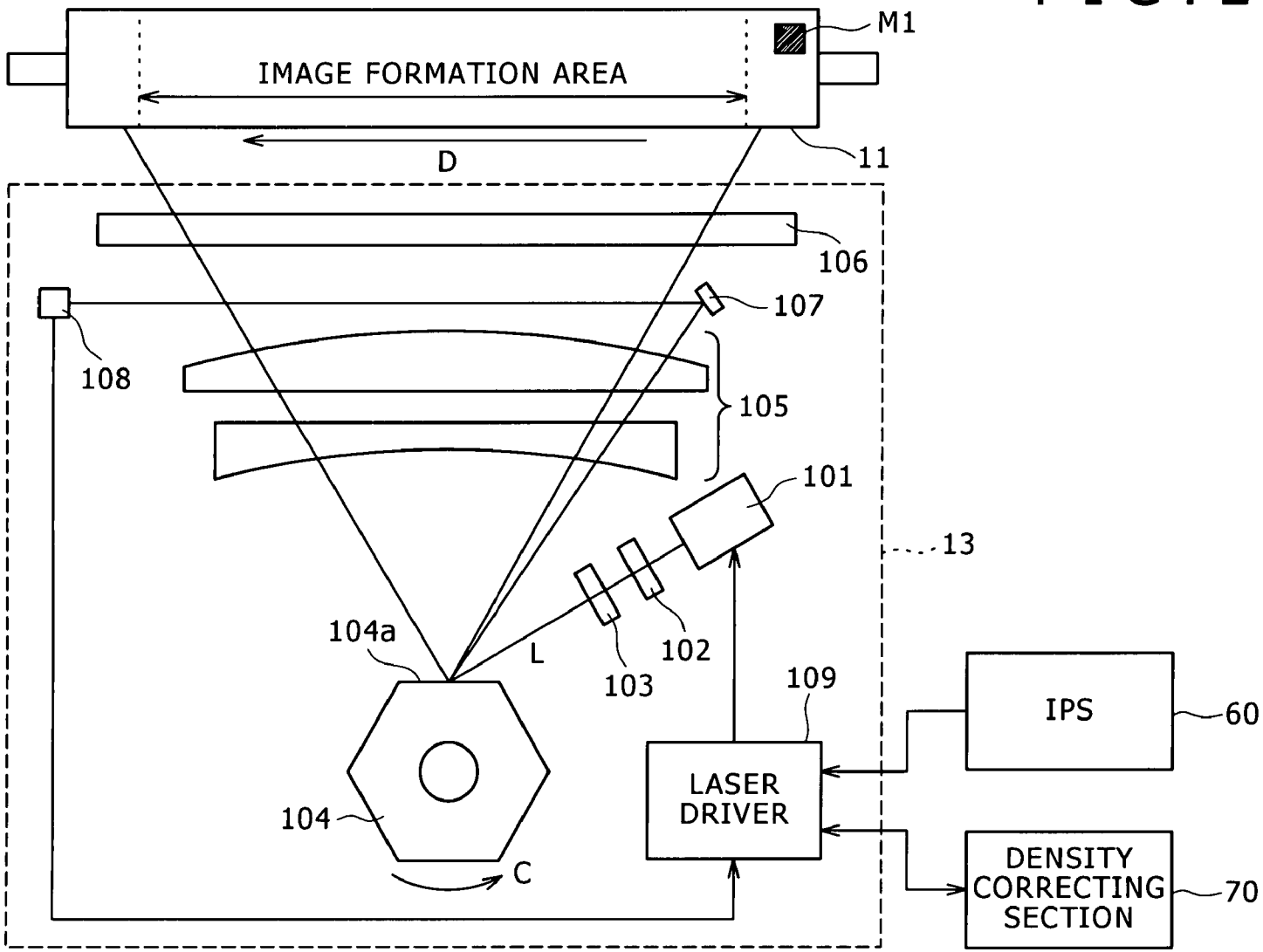
FIG. 2 is a diagram to illustrate the configuration of an exposure unit and a state in which the exposure unit illuminates and scans a photoconductor drum.

FIG. 2 is a diagram to illustrate the configuration of the exposure unit 13 as a third submodule or the imaging condition changing section and a state in which the exposure unit 13 scans and illuminates the photoconductor drum 11 as a photoconductor. The exposure unit 13 includes a light source 101 which is made up of a semiconductor laser, a collimator lens 102, a cylinder lens 103, and a rotary polygon mirror 104 formed in, for example, a regular hexahedron. The exposure unit 13 further includes a fθ lens 105, a loopback mirror 106, a reflecting mirror 107, and a Start Of Scan (SOS) sensor 108.

In the exposure unit 13, an emanative laser beam L emitted from the light source 101 is converted into parallel light by the collimator lens 102 and, by the cylinder lens 103 having a refractive power only in a slow-scan direction, the light is focused proximally on a deflective reflection surface 104*a* of the polygon mirror 104 as a line image that is long in a fast-scan direction. Then, the laser beam L is reflected by the deflective reflection surface 104*a* of the polygon mirror 104 rotating at a constant high speed and scanned counterclockwise (in the direction of arrow C) at a constant angular velocity. After the laser beam L passes through the fθ lens 105, its direction is changed by the loopback mirror 106 so as to go toward the surface of the photoconductor drum 11 and the laser beam L scans and illuminates the surface of the photoconductor drum 11 in the direction of arrow D. Here, the fθ lens 105 has a function to equalize the velocity of a light spot scan of the laser beam L. The above line image is focused proximally on the deflective reflection surface 104*a* of the polygon mirror 104 and the fθ lens 105 focuses a light spot on the surface of the photoconductor drum 11, with the deflective reflection surface 104*a* being an object point with regard to the slow-scan direction. Therefore, this scan optics assembly has a function to correct an optical face tangle error of the deflective reflection surface 104*a*.

Before scanning and illuminating the surface of the photoconductor drum 11, the laser beam L reaches the SOS sensor 108 via the reflecting mirror 107. In other words, each time the laser beam L scans and illuminates the surface of the photoconductor drum 11, the first laser beam L for each scan line reaches the SOS sensor 108. Then, the SOS sensor 108 detects the timing of illumination per scan line on the surface of the photoconductor drum 11 and generates a signal indicative of the timing to start the illumination (SOS signal which will be described later).

To the light source 101, a laser driver 109 is connected which outputs a laser drive signal corresponding to image data to write, output from an image signal generating section (Image Processing System; IPS) 60, at predetermined timing. The laser driver 109 controls turning on/off of the semiconductor laser of the light source 101, according to the image data to write from the IPS 60. Thereby, the laser beam L corresponding to the image data to write is output from the light source 101.

The laser driver 109 is also connected to the SOS sensor 108 and the SOS signal generated by the SOS sensor 108 is input to it. Then, the laser driver 109 sets the timing to start outputting the laser drive signal to the semiconductor laser of the light source 101, according to the SOS signal from the SOS sensor 108.

Furthermore, a density correcting section 70 is connected to the laser driver 109. This density correcting section 70 generates a light quantity setting signal to suppress non-uniformity in density in the slow-scan direction caused by each of the plural units such as the photoconductor drum 11 and a developing roller (which will be described later in the developing unit 14 (see FIG. 1) and outputs this signal to the laser driver 109. According to the light quantity setting signal from the density correcting section 70, the laser driver 109 adjusts the light quantity of the laser beam L that is output from the semiconductor laser of the light source 101. The adjustment of the light quantity of the laser beam L is performed between the detection of the SOS signal and the actual scan and illumination on the surface of the photoconductor drum 11, as described later.

In this way, in this exemplary embodiment, by operating the exposure unit 13 in accordance with the light quantity setting signal set by the density correcting section 70, non-uniformity in density in the slow-scan direction is suppressed. The density correcting section 70 acquires data indicative of density non-uniformity occurrence in the slow-scan direction at appropriate timing and, according to this result, sets plural data pieces for light quantity correction to generate the light quantity setting signal.

Figure 3:
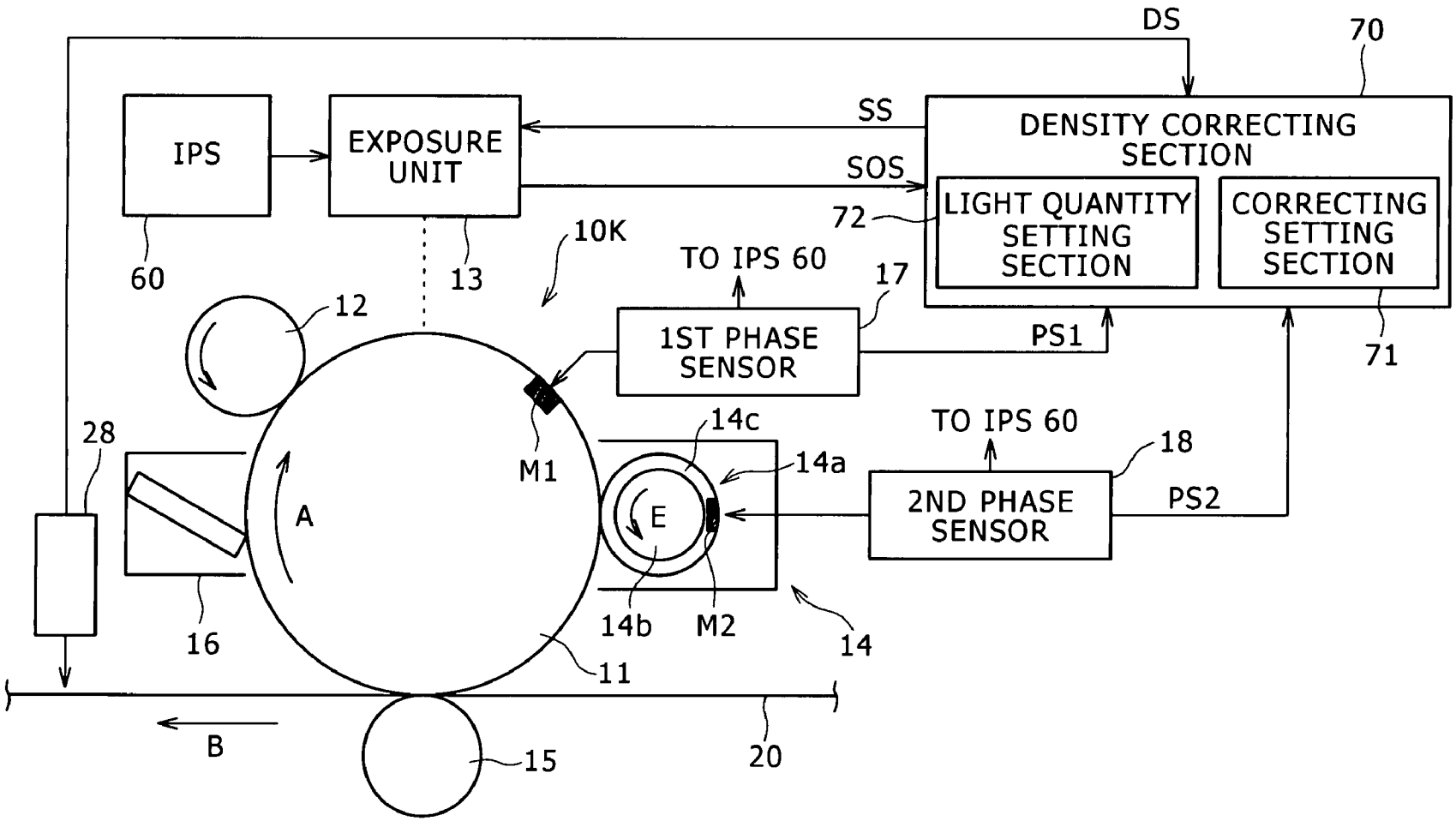
FIG. 3 is a diagram to illustrate input and output of various signals to/from the density correcting section.

Next, setting plural data pieces for light quantity correction and generating the light quantity setting signal in the density correcting section 70 are described in detail. FIG. 3 is a diagram to illustrate input and output of various signals to/from the density correcting section 70. Although only the image forming unit 10K for black is shown in FIG. 3, other image forming units 10Y, 10M, and 10C are also connected to the density correcting section 70.

In this exemplary embodiment, the density correcting section 70 includes a correction setting section 71 and a light quantity setting section 72. The correction setting section 71 sets plural (two in this exemplary embodiment) data pieces for light quantity correction which is used to generate the light quantity setting signal SS. On the other hand, the light quantity setting section 72 generates the light quantity setting signal SS from the plural data pieces for light quantity correction, set by the correction setting section 71.

On the surface of the photoconductor drum 11 as the first submodule, a first mark M1 is formed. This first mark M1 is formed outside an image formation area (where an electrostatic latent image and a toner image can be formed) on the photoconductor drum 11, for example, as shown in FIG. 2. A first phase sensor 17 to detect this first mark M1 is located so as to face the photoconductor drum 11. The first phase sensor 17 as the first phase detector detects the first mark M1 for every rotation of the photoconductor drum 11. Then, the first phase sensor 17 outputs the result of detecting the first mark M1, as a first phase signal PS1, to the density correcting section 70. The first phase sensor 17 outputs the first phase signal PS1 to the IPS 60 as well.

The developing unit 14 includes a developing roller 14*a* as the second submodule that carries a toner not shown and moves it to a development area facing the photoconductor drum 11. The developing roller 14*a* includes a magnet roller 14*b* having an array of plural magnetic poles fixedly disposed on its surface and a developing sleeve 14*c* which is attached rotatably to the outer circumferential surface of the magnet roller 14*b*. For this developing unit 14, a two-component developer containing a toner and a carrier is used. This two-component developer is carried on the developing sleeve 14*c* by a magnetic force exerted between the carrier and the magnet roller 14 and moved by the rotation of the developing sleeve 14*c*. In this exemplary embodiment, the developing sleeve 14*c* is driven in a direction of E that is the same as a direction of A in which the photoconductor drum 11*c* rotates. On the surface of the developing sleeve 14*c*, a second mark M2 is formed. This second mark M2 is formed outside a region facing the image formation area on the photoconductor drum 11. A second phase sensor 18 to detect this second mark M2 is located so as to face the developing roller 14*a* (developing sleeve 14*c*). The second phase sensor 18 as a second phase detector detects the second mark M2 for every rotation of the developing sleeve 14*c*. Then, the second phase sensor 18 outputs the result of detecting the second mark M2, as a second phase signal PS2, to the density correcting section 70. The second phase sensor 18 outputs the second phase signal PS2 to the IPS 60 as well.

Here, the first mark M1 and the second mark M2 can be formed by, for example, as shown, painting a part of the surface of the photoconductor drum 11 and of the developing sleeve 14*c*; however, other methods can also be used. Specifically, these marks can be provided by, for example, changing the surface condition (e.g., surface roughness) of a part of the photoconductor drum 11 and of the developing sleeve 14*c* or defining a notch in a part of the rim thereof.

As an alternative to the method of reading the marks by using the sensors, the rotation periods of the photoconductor drum 11 and the developing sleeve 14*c* can be acquired by, for example, providing sensors to detect the driving torques of the photoconductor drum 11 and the developing sleeve 14*c* and counting the number of pulses of the motors that drive the photoconductor drum 11 and the developing sleeve 14*c*.

Moreover, the density sensor 28 detects the density of a toner image first-transferred onto the intermediate transfer belt 20 and outputs detected density signals DS as results of the detection to the density correcting section 70.

Then, the exposure unit 13 outputs the SOS signal SOS generated by the SOS sensor 108 (see FIG. 2) to the density correcting section 70. On the other hand, the density correcting section 70 outputs the generated light quantity setting signal SS to the exposure unit 13.

Figure 4:
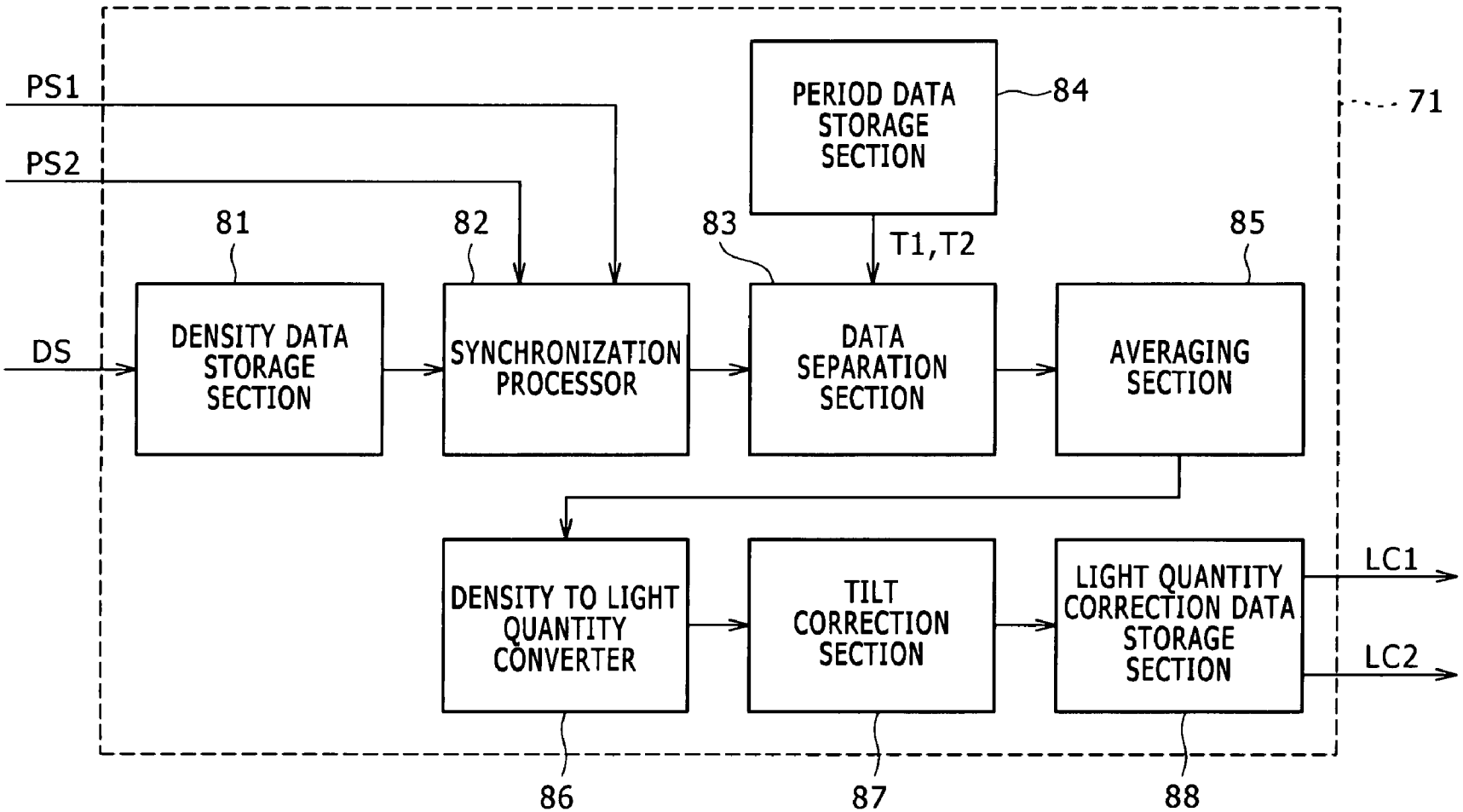
FIG. 4 is a diagram to illustrate the configuration of a correction setting section in the density correcting section.

FIG. 4 is a diagram to illustrate the configuration of the correction setting section 71 in the density correcting section 70 shown in FIG. 3. The correction setting section 71 includes a density data storage section 81, a synchronization processor 82, a data separation section 83, a period data storage section 84, and an averaging section 85. The correction setting section 71 further includes a density to light quantity converter 86, a tilt correction section 87, and a light quantity correction data storage section 88.

The density data storage section 81 stores detected density signals DS which are input from the density sensor 28 (see FIG. 3) as density data sequenced in the slow-scan direction. The synchronization processor 82 associates and synchronies density data which has been read from the density data storage section 81 with first phase signals PS1 incoming from the first phase sensor 17. Specifically, it determines which position of density data corresponds to the point of the first mark M1 formed on the photoconductor drum 11. The synchronization processor 82 also associates and synchronizes density data which has been read from the density data storage section 81 with second phase signals PS2 incoming from the second phase sensor 18. Specifically, it determines which position of density data corresponds to the point of the second mark M2 formed on the developing sleeve 14*c*.

The period data storage section 84 stores a period in which the photoconductor drum 11 makes one full rotation (this is referred to as a first period T1 in the following description) and a period in which the developing sleeve 14*c* makes one full rotation (this is referred to as a second period T2 in the following description). These first period T1 and second period T2 are predetermined, based on the outside diameters and the respective rotating speeds of the photoconductor drum 11 and the developing sleeve 14*c*. The data separation section 83 reads the first period T1 and the second period T2 from the period data storage section 84. The data separation section 83 separates density data (which is referred to as first density data) for each first period T1 (during the plural first periods T1) in plural rotations of the photoconductor drum 11 from phase-synchronized density data incoming from the synchronization processor 82. The data separation section 83 also separates density data (which is referred to as second density data) for each second period T2 (during the plural second periods T2) in plural rotations of the developing sleeve 14*c* from phase-synchronized density data incoming from the synchronization processor 82.

The averaging section 85 averages the plural first density data pieces incoming from the data separation section 83 for each of the corresponding positions on the photoconductor drum 11. The averaging section 85 averages the plural second density data pieces incoming from the data separation section 83 for each of the corresponding positions on the developing sleeve 14*c*. The density to light quantity converter 86 converts the first density data averaged by the averaging section 85 into light quantity data (which is referred to as first light quantity correction data before tilt correction). The density to light quantity converter 86 also converts the second density data averaged by the averaging section 85 into light quantity data (which is referred to as second light quantity correction data before tilt correction).

The tilt correction section 87 makes tilt correction on the first light quantity correction data before tilt correction incoming from the density to light quantity converter 86 and outputs the result as first light quantity correction data LC1. The tilt correction section 87 also makes tilt correction on the second light quantity correction data before tilt correction incoming from the density to light quantity converter 86 and outputs the result as second light quantity correction data LC2. Then, the light quantity correction data storage section 88 as the correction data storage section stores these first light quantity correction data LC1 and second light quantity correction data LC2. The first light quantity correction data LC1 and the second light quantity correction data LC2 stored in the light quantity correction data storage section 88 are output as requested from the light quantity setting section 72 (see FIG. 3).

Figure 5:
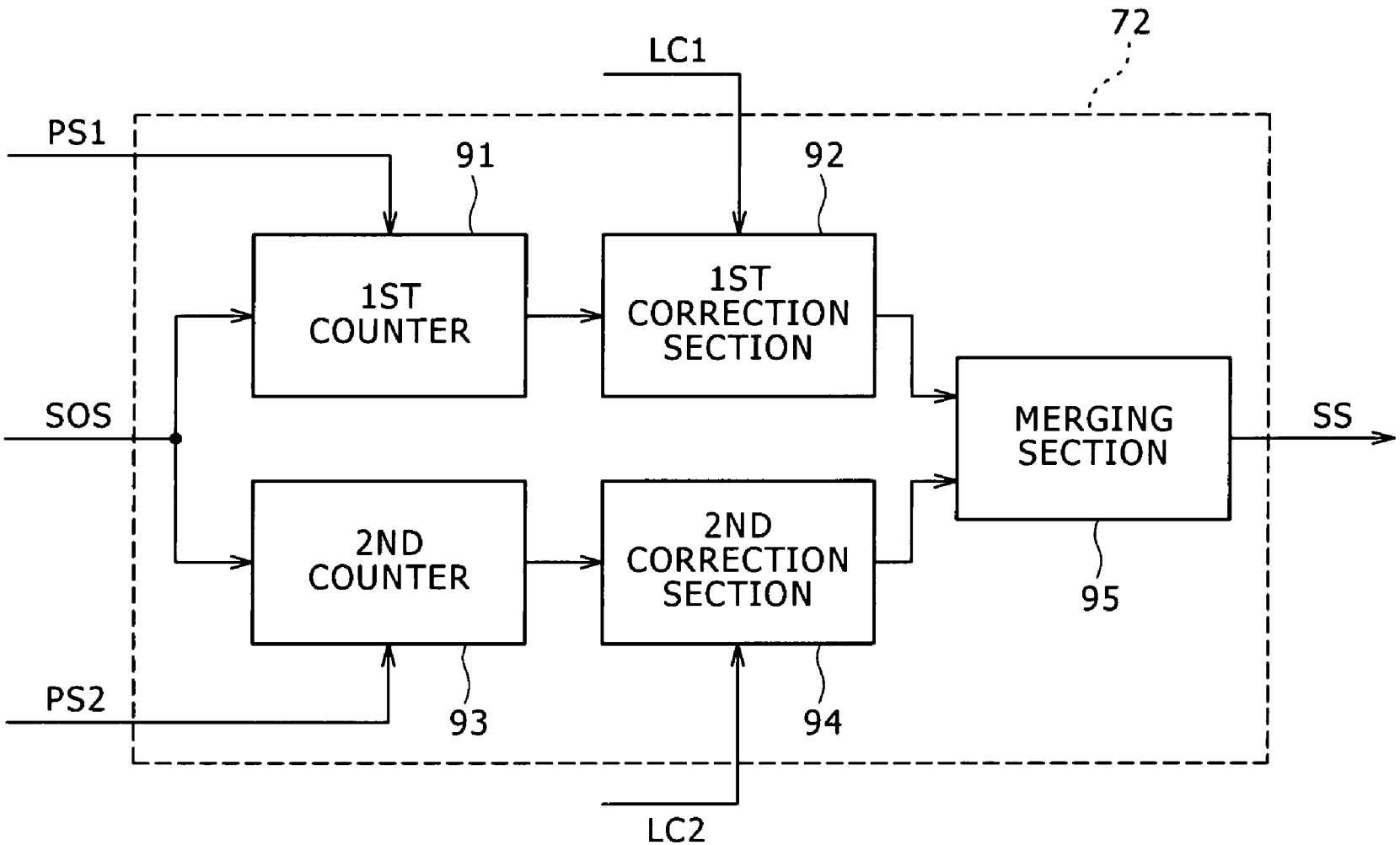
FIG. 5 is a diagram to illustrate the configuration of a light quantity setting section in the density correcting section.

FIG. 5 is a diagram to illustrate the configuration of the light quantity setting section 72 in the density correcting section 76 shown in FIG. 3. The light quantity setting section 72 as the output setting section includes a first counter 91, a first correction section 92, a second counter 93, a second correction section 94, and a merging section 95.

The first counter 91 counts the number of SOS signals that are input from the SOS sensor 108 (see FIG. 2). To the first counter 91, the first phase signal PS1 from the first phase sensor 17 (see FIG. 3) is input. The first counter 91 is configured such that its count value (which is referred to as a first count value) is reset, each time the first phase signal PS1 is input to it. The first correction section 92 refers to the first light quantity correction data LC1 which has been read from the light quantity correction data storage section 88 (see FIG. 4) in the correction setting section 71 and outputs a first correction value for the first count value incoming from the first counter 91.

The second counter 93 counts the number of SOS signals that are input from the SOS sensor 108 (see FIG. 2). To the second counter 93, the second phase signal PS2 from the second phase sensor 18 (see FIG. 3) is input. The second counter 93 is configured such that its count value (which is referred to as a second count value) is reset, each time the second phase signal PS2 is input to it. Here, in this exemplary embodiment, because the period of the photoconductor T1 is basically unequal to the period of development T2, the first count value is basically different from the second count value. The second correction section 94 refers to the second light quantity correction data LC2 which has been read from the light quantity correction data storage section 88 (see FIG. 4) in the correction setting section 71 and outputs a second correction value for the second count value incoming from the second counter 93.

The merging section 95 adds in real time the first correction value incoming from the first correction section 92 and the second correction value incoming from the second correction section 94, thereby merges these values, and outputs the thus merged value as the light quantity setting signal SS that is a correction value. The merging section 95 adds the first correction value and the second correction value for the same line number in the fast-scan direction corresponding to the same SOS signal SOS.

Figure 6:
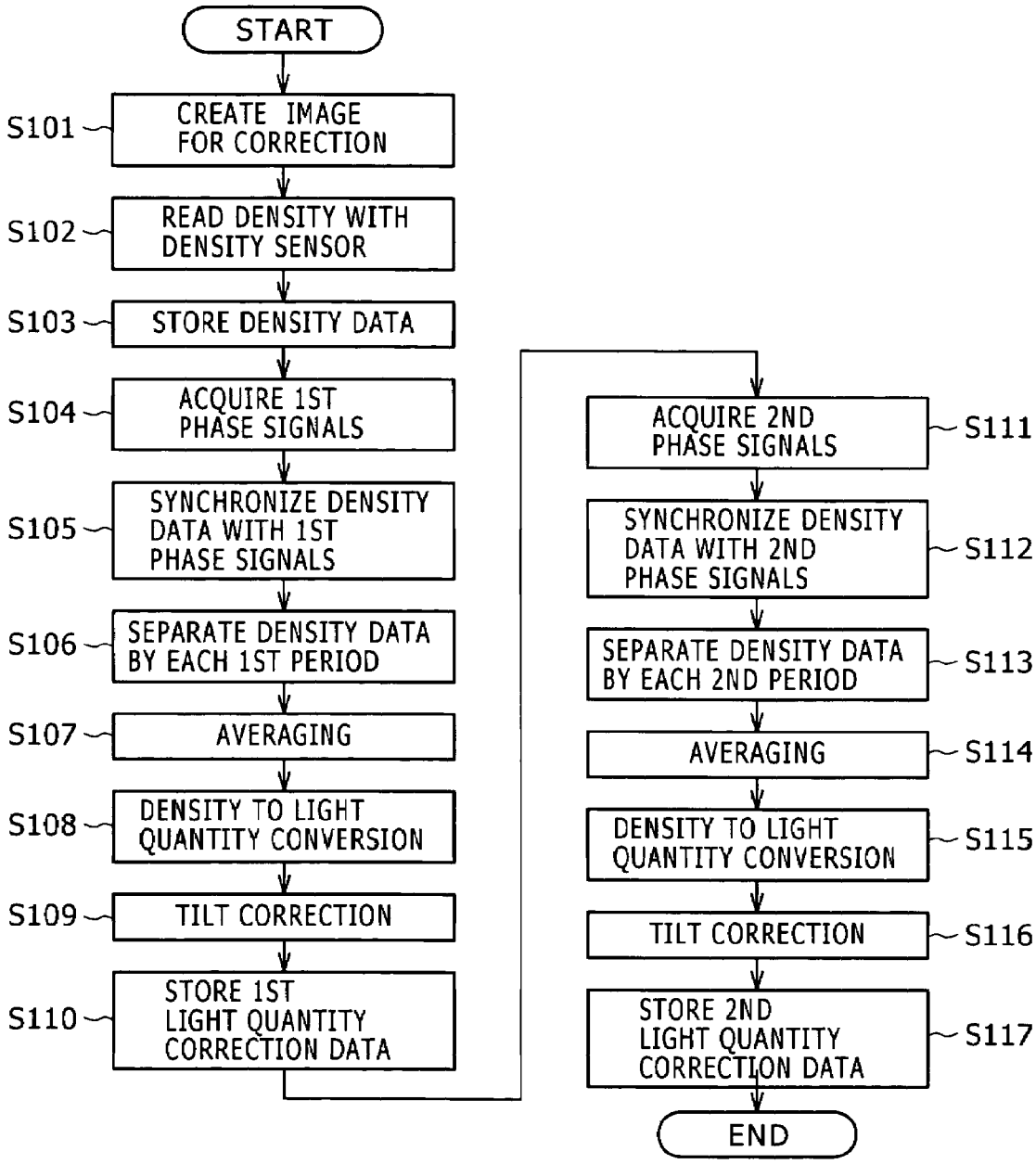
FIG. 6 is a flowchart to illustrate a process of acquiring plural data pieces for light quantity correction by the correction setting section.

FIG. 6 is a flowchart to illustrate a process of acquiring plural data pieces for light quantity correction (in this exemplary embodiment, the first light quantity correction data LC1 (first parameter, first density correction data) for the photoconductor drum 11 and the second light quantity correction data LC2 (second parameter, second density correction data) for the developing sleeve 14*c*) by the above correction setting section 71.

In this process, first, an image for correction is created by the image forming apparatus (step 101). Specifically, a toner image is formed on the intermediate transfer belt 20 by performing a series of charging, exposure, development, and first transfer. The image for correction is basically a half-tone image; details thereof will be described later.

Next, the density of the toner image formed on the intermediate transfer belt 20 is read by the density sensor 28 (step 102) and detected density signals DS are output to the light quantity setting section 72. Upon receiving these signals, the light quantity setting section 72 stores the detected density signals DS as density data sequenced in the slow-scan direction into the light quantity correction data storage section 88 (step 103).

Next, the synchronization processor 82 acquires first phase signals PS1 incoming from the first phase sensor 17 (step 104). Then, the synchronization processor 82 associates and synchronizes density data which has been read from the density data storage section 81 with the acquired first phase signals PS1 (step 105). The data separation section 83 separates first density data for each first period T1 in plural rotations of the photoconductor drum 11 from phase-synchronized density data incoming from the synchronization processor 82 (step 106). Then, the averaging section 85 averages the plural first density data pieces for each of the corresponding positions on the photoconductor drum 11 (step 107). The density to light quantity converter 86 makes conversion from density to light quantity for the first density data averaged by the averaging section 85 (step 108). The tilt correction section 87 makes tilt correction on the data resulting from the density to light quantity conversion (step 109) and outputs the result as first light quantity correction data LC1. Then, the light quantity correction data storage section 88 stores the incoming first light quantity correction data LC1 (step 110).

Next, the synchronization processor 82 acquires second phase signals PS2 incoming from the second phase sensor 18 (step 111). Then, the synchronization processor 82 associates and synchronizes density data which has been read from the density data storage section 81 with the acquired second phase signals PS2 (step 112). The data separation section 83 separates second density data for each second period T2 in plural rotations of the developing sleeve 14*c* from phase-synchronized density data incoming from the synchronization processor 82 (step 113). Then, the averaging section 85 averages the plural second density data pieces for each of the corresponding positions on the developing sleeve 14*c* (step 114). The density to light quantity converter 86 makes conversion from density to light quantity for the second density data averaged by the averaging section 85 (step 115). The tilt correction section 87 makes tilt correction on the data resulting from the density to light quantity conversion (step 116) and outputs the result as second light quantity correction data LC2. Then, the light quantity correction data storage section 88 stores the incoming second light quantity correction data LC2 (step 117).

Through the above process, the first light quantity correction data LC1 to correct non-uniformity in density in the slow-scan direction caused by the photoconductor drum 11 and the second light quantity correction data LC2 to correct non-uniformity in density in the slow-scan direction caused by developing sleeve 14*c* can be acquired. In the described procedure, the first light quantity correction data LC1 is first acquired and, then, the second light quantity correction data LC2 is acquired; however, this order may be reversed.

The above process flow illustrated in FIG. 6 is further explained in detail, using a concrete example.

Figure 7A:
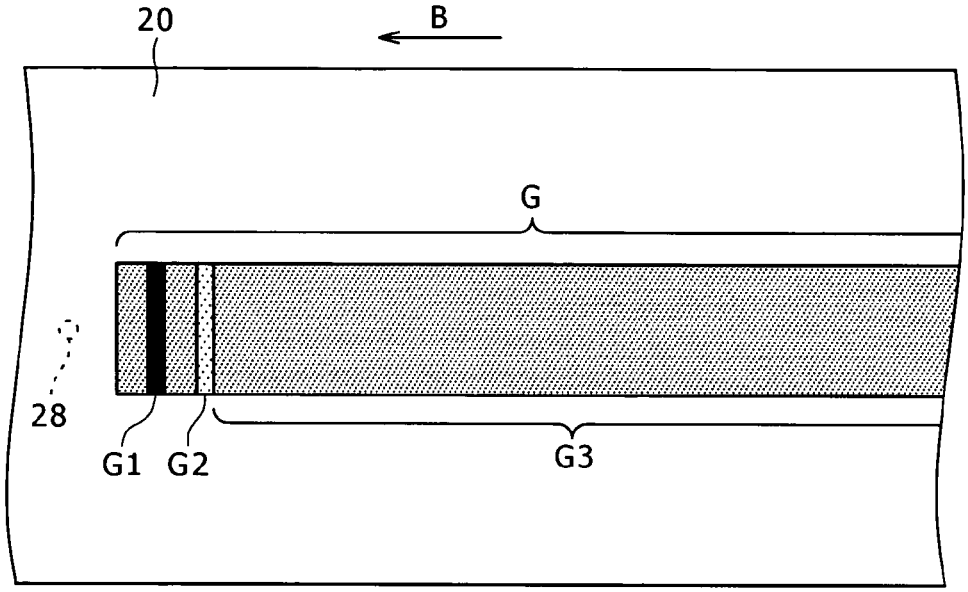
FIG. 7A represents an image for correction created on an intermediate transfer belt.

FIG. 7A represents an image G for correction created by the above step 101, first-transferred onto the intermediate transfer belt 20. In this exemplary embodiment, when creating the image G for correction, an electrostatic latent image corresponding to a half-tone image is formed on the photoconductor drum 11 for each color. At this time, the IPS 60 outputs image data to write, as will be described below, to the exposure unit 13. Having received an instruction to create an image for correction, the ISP 60 first outputs image data to write corresponding to a half-tone image (e.g., with a density of 50%)(this image data is referred to as half-tone data). Then, when the first mark M1 is detected by the first phase sensor 17, the IPS 60, in response to this, outputs image data to write corresponding to an image with a higher density (e.g., a density of 60%) than the half-tone data (this image data is referred to as first mark data) to the exposure unit 13 only for a give time. Following the output of the first mark data, the IPS 60 again outputs the half-tone data to the exposure unit 13. Then, when the second mark M2 is detected by the second phase sensor 18, the IPS 60, in response to this, outputs image data to write for an image with a lower density (e.g., a density of 40%) that the half-tone data (this image data is referred to as second mark data) to the exposure unit 13 only for a given time. Following the output of the second mark data, the IPS 60 further outputs the half-tone data to the exposure unit 13. Then, the half-tone data is output during at least three rotations or more of the photoconductor drum 11.

The electrostatic latent images thus formed on the photoconductor drums 11 are, after developed with toner, first-transferred to the intermediate transfer belt 20. Then, the image G for correction formed on the intermediate transfer belt 20 includes a first image G1 with a higher density corresponding to the first mark data, a second image G2 with a lower density corresponding to the second mark data, and a third image G3 with a medium density corresponding to the subsequent half-tone data.

Then, as the intermediate transfer belt 20 moves in the direction of arrow B, the image for correction G passes a point facing the density sensor 28 serially and is read by the density sensor 28. In FIG. 7A, an area of reading by the density sensor 28 is denoted by a dashed circle.

Figure 7B:
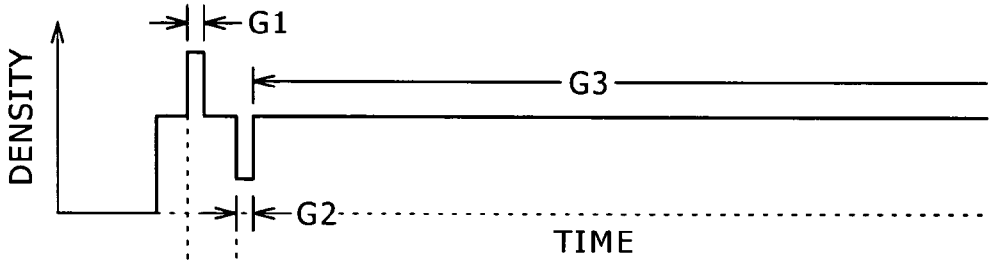
FIG. 7B represents density data acquired by reading the image for correction.
Figure 8A:
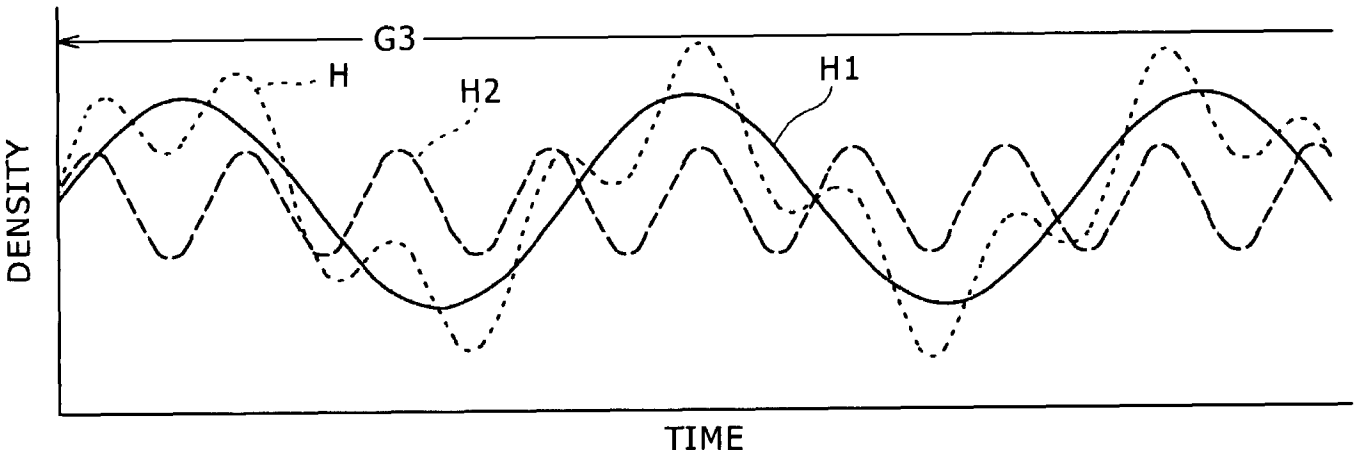
FIG. 8A represents density data obtained by reading a third image portion of the image for correction.

FIG. 7B represents density data that is read by the density sensor 28 in the above step 102 and stored into the density data storage section 81 in the above step 103. In FIG. 7B, the abscissa is time and the ordinate is density. The density sensor 28 outputs detected density signals DS obtained by reading the image for correction G. Here, the density sensor 28 outputs a detected density signal DS having a higher level than the third image G3 upon reading the first image G1 and a detected density signal DS having a lower level than the third image G3 upon reading the second image G2. In FIG. 7B, a substantially constant detected density signal DS is output during reading of the third image G3; this is observed from a macro perspective. From a micro perspective, however, there appears some non-uniformity in density caused by the photoconductor drum 11, the developing sleeve 14*c*, etc., as is shown in FIG. 8A.

Figure 7C:
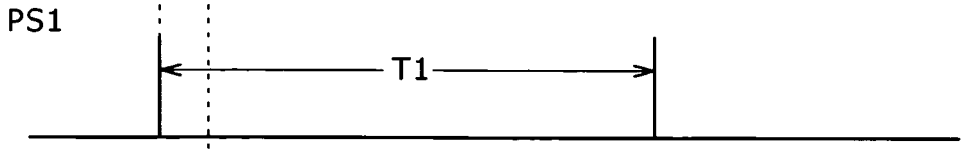
FIG. 7C represents first phase signals.

FIG. 7C represents first phase signals PS1 that are acquired by the synchronization processor 82 in the above step 104. A time interval between successive first phase signals PS1 corresponds to the first period T1 which is the rotation period of the photoconductor drum 11. In the above step 105, the synchronization processor 82 makes synchronization between the density data and the first phase signals PS1 as follows. The synchronization processor 82 first detects a position of reading of the first image G1 having a higher density than a predetermined first threshold from the density data retrieved from the density data storage section 81. Then, the synchronization processor 82 synchronizes the rise timing of a first phase signal PS1 acquired with the onset timing of reading the first image G1, as shown in FIGS. 7B and 7C. As described above, the first image G1 is formed, triggered by the detection of the first mark M1 by the first phase sensor 17. Therefore, by performing this synchronization processing, it is possible to determine which position of density data corresponds to the formation point of the first mark M1 on the photoconductor drum 11. In short, it is possible to associate the acquired density data with the position scale on the circumferential surface of the photoconductor drum 11.

Figure 7D:
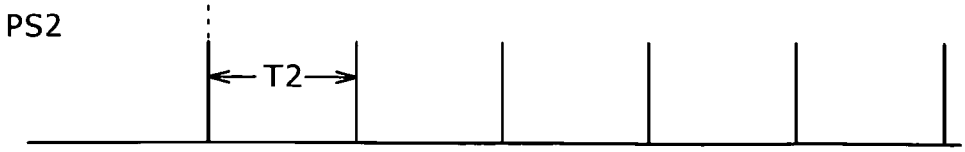
FIG. 7D represents second phase signals.

On the other hand, FIG. 7D represents second phase signals PS2 that are acquired by the synchronization processor 82 in the above step 111. A time interval between successive second phase signals PS2 corresponds to the second period T2 which is the rotation period of the developing sleeve 14*c*. In the above step 112, the synchronization processor 82 makes synchronization between the density data and the second phase signals PS2 as follows. The synchronization processor 82 first detects a position of reading of the second image G2 having a lower density than a predetermined second threshold from the density data retrieved from the density data storage section 81. Then, the synchronization processor 82 synchronizes the rise timing of a second phase signal PS2 acquired with the onset timing of reading the second image G2, as shown in FIGS. 7B and 7D. As described above, the second image G2 is formed, triggered by the detection of the second mark M2 by the second phase sensor 18. Therefore, by performing this synchronization processing, it is possible to determine which position of density data corresponds to the formation point of the second mark M2 on the developing sleeve 14*c*. In short, it is possible to associate the density data with the position scale on the circumferential surface of the developing sleeve 14*c*.

In this example, the period of the interval between the first phase signals PS1 appearing (the first period T1 of the photoconductor drum 11) is set over three times (at a non-integral multiple of) the period of the interval between the second phase signals PS2 appearing (the second period T2 of the developing sleeve 14*c*). Therefore, the photoconductor drum 11 and the developing sleeve 14*c* are driven in an asynchronous state.

FIG. 8A represents an enlarged view of density data H obtained by reading the third image G3 shown in FIG. 7B. In FIG. 8A, the abscissa is time and the ordinate is density. As shown in FIG. 8A, even in the third image G3 that would have normally an uniform density (a density of 50%), density fluctuation, namely, non-uniformity in density actually takes place around the density of 50%. In this example, a description is provided, assuming that non-uniformity in density in the density data H is attributed to the combination of periodic density non-uniformity H1 of the photoconductor drum 11 and periodic density non-uniformity H2 of the developing sleeve 14*c*, shown in FIG. 8A.

Figure 8B:
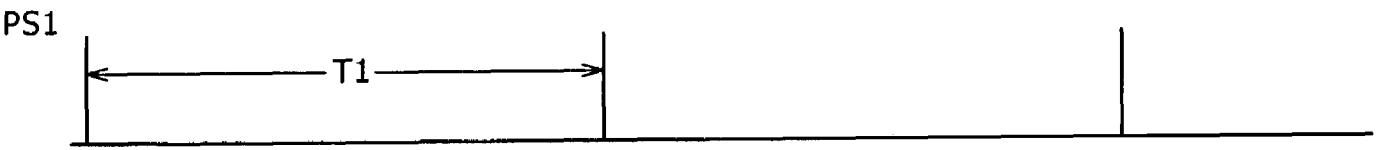
FIG. 8B represents first phase signals synchronized with density data.
Figure 8C:
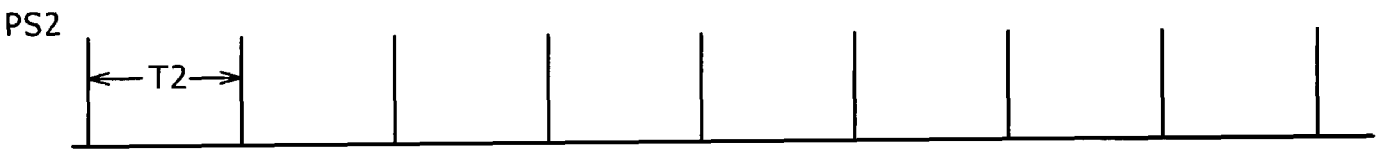
FIG. 8C represents second phase signals synchronized with density data.

FIG. 8B represents the first phase signals PS1 synchronized with the density data H in the above step 105. On the other hand, FIG. 8C represents the second phase signals PS2 synchronized with the density data H in the above step 112.

Figure 9A:
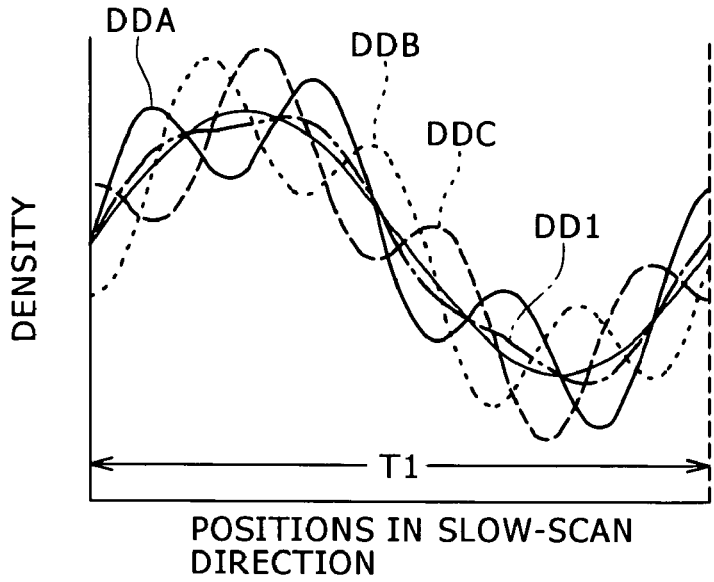
FIG. 9A represents first density data separated by each first period from the density data and first density data averaged.

FIG. 9A represents plural first density data pieces DDA to DDC separated by each first period T1 by the data separation section 83 in the above step 106. In FIG. 9A, the abscissa represents positions in the slow-scan direction on the photoconductor drum 11 relative to the formation point of the first mark M1 as the origin and the ordinate is density. Here, in this exemplary embodiment, when the data separation section 83 separates data, sampling is performed per line in the fast-scan direction. Therefore, if the diameter of the photoconductor drum 11 is ϕ28 and the resolution in the slow-scan direction of the image forming apparatus is, for example, 600 psi, first density data of DDA, DDB, and DDC each will contain a total of 2078 pieces of sampling data from the start to the end of the period.

In this example, first density data DDA, DDB, and DDC are separated in this order from the density data H. In consequence, for example, a value of DDA at the end of the period is followed by a value of DDB at the start of the period.

FIG. 9A also shows first density data DD1 averaged in the above step 107. By thus averaging the plural first density data pieces DDA to DDC for each of the corresponding positions, the influence of the non-uniformity in density induced by the developing sleeve 14*c* can be reduced. In other words, this averaged non-uniformity can be made close to the density non-uniformity induced by the photoconductor drum 11 (denoted by a thin solid line in the graph). If more samples of first density data are taken and averaged, the averaged first density data DD1 can be made closer to a true value. However, because a longer third image G3 needs to be created accordingly, the samples for three rotation periods are used in this example.

Figure 9B:
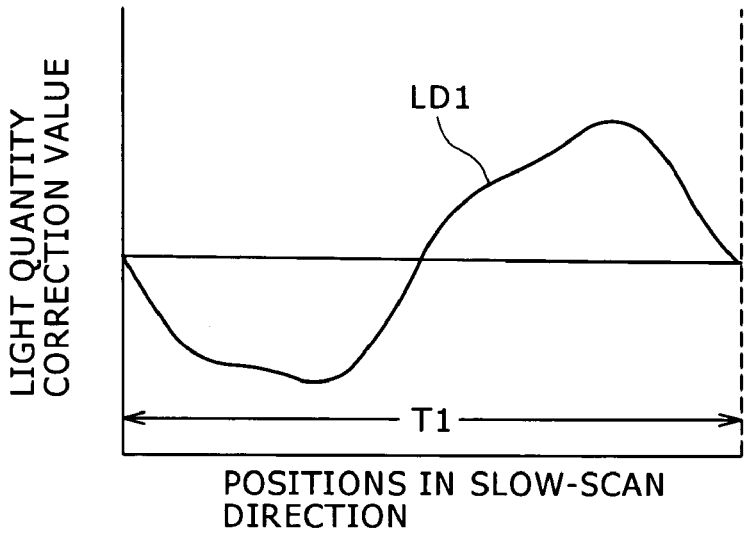
FIG. 9B represents first light quantity correction data before tilt correction.

FIG. 9B represents the result of the conversion of density to light quantity for the averaged first density data DD1 (see FIG. 9A), performed in the above step 108, namely, first light quantity correction data before tilt correction LD1. In FIG. 9B, the abscissa represents positions in the slow-scan direction on the photoconductor drum 11 relative to the formation point of the first mark M1 as the origin and the ordinate represents light quantity correction values. In this exemplary embodiment, the positions within the toner image formation area on the charged surface of the photoconductor drum 11 are illuminated by the exposure unit 13. Therefore, in order to form a toner image with a uniform density in this area, it is needed to decrease the quantity of light to illuminate the positions corresponding to a higher density portion of the third image G3 formed to decrease the density and increase the quantity of light to illuminate the positions corresponding to a lower density portion of the third image to increase the density.

Figure 9C:
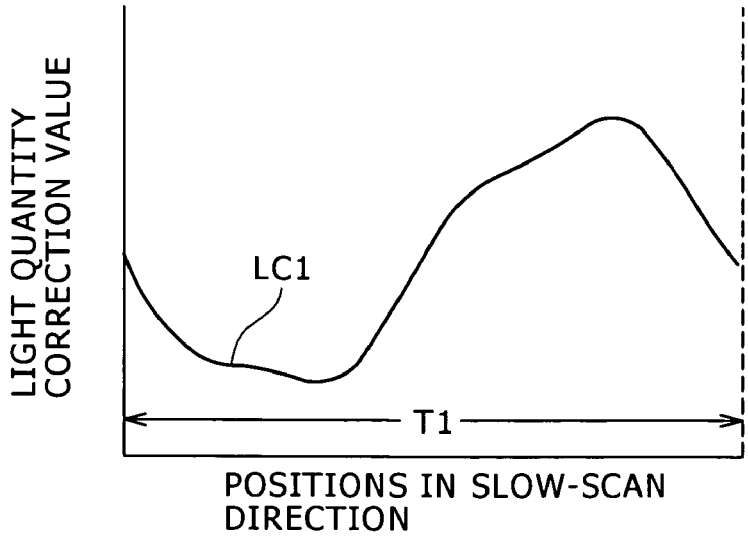
FIG. 9C represents first light quantity correction data.

FIG. 9C represents first light quantity correction data LC1 subjected to tilt correction in the above step 109 and stored into the light quantity correction data storage section 88 in the above step 110. In FIG. 9C, the abscissa represents positions in the slow-scan direction on the photoconductor drum 11 relative to the formation point of the first mark M1 as the origin and the ordinate represents light quantity correction values. The tilt correction section 87 obtains a tilt from a difference between a value at the start of the period and a value at the end of the period in the first light quantity correction data LD1 before tilt correction and performs tilt correction so that the value at the start of the period matches the value at the end of the period. Because there is hardly a difference between the value at the start of the period and the value at the end of the period in the first light quantity correction data LD1 before tilt correction in this example, the first light quantity correction data LC1 that is almost the same as the first light quantity correction data LD1 before tilt correction is obtained.

Figure 10A:
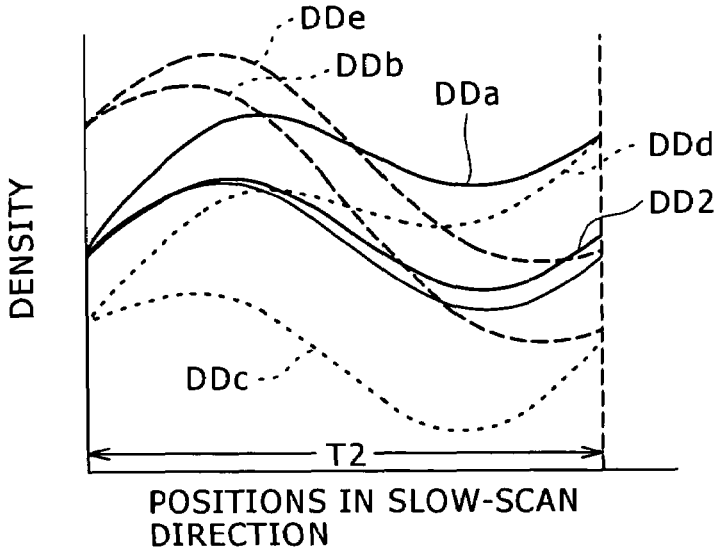
FIG. 10A represents second density data separated by each second period from the density data and second density data averaged.

On the other hand, FIG. 10A represents plural second density data pieces DDa to DDe separated by each second period T2 by the data separation section 83 in the above step 113. In FIG. 10A, the abscissa represents positions in the slow-scan direction on the developing sleeve 14*c* relative to the formation point of the second mark M2 as the origin and the ordinate is density. Here, in this exemplary embodiment, sampling is performed per line in the fast-scan direction, as described above.

In this example, second density data pieces DDa, DDb, DDc, DDd, and DDe are separated in this order from the density data H. In consequence, for example, a value of DDa at the end of the period is followed by a value of DDb at the start of the period.

FIG. 10A also shows second density data DD2 averaged in the above step 114. By thus averaging the plural second density data pieces DDa to DDe for each of the corresponding positions, the influence of the non-uniformity in density induced by the photoconductor drum 11 can be reduced. In other words, this averaged non-uniformity can be made close to the density non-uniformity induced by the developing sleeve 14*c* (denoted by a thin solid line in the graph). In this example, because the second period T2 of the developing sleeve 14*c* is shorter than the first period T1 of the photoconductor drum 11, the samples for the second density data correspond to five periods more than the samples for the first density data.

Figure 10B:
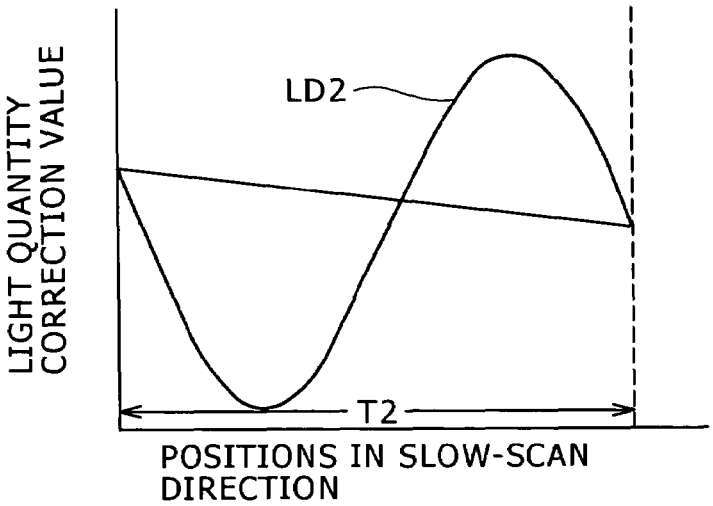
FIG. 10B represents second light quantity correction data before tilt correction.

FIG. 10B represents the result of the conversion of density to light quantity for the averaged second density data DD2 (see FIG. 10A), performed in the above step 115, namely, second light quantity correction data LD2 before tilt correction. In FIG. 10B, the abscissa represents positions in the slow-scan direction on the developing sleeve 14*c* relative to the formation point of the second mark M2 as the origin and the ordinate represents light quantity correction values.

Figure 10C:
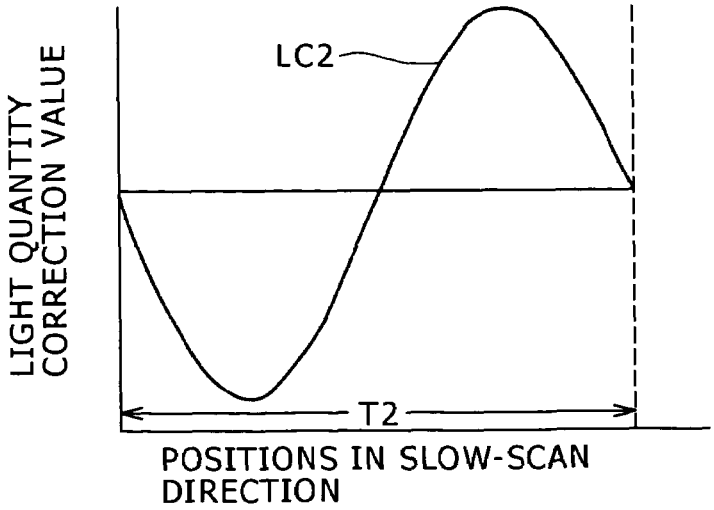
FIG. 10C represents second light quantity correction data.

FIG. 10C represents second light quantity correction data LC2 subjected to tilt correction but the tilt correction section 87 in the above step 116 and stored into the light quantity correction data storage section 88 in the above step 117. In FIG. 10C, the abscissa represents positions in the slow-scan direction on the developing sleeve 14*c* relative to the formation point of the second mark M2 as the origin and the ordinate represents light quantity correction values. The tilt correction section 87 obtains a tilt from a difference between a value at the start of the period and a value at the end of the period in the second light quantity correction data LD2 before tilt correction and performs tilt correction so that the value at the start of the period matches the value at the end of the period. In this example, there is a large difference between the value at the start of the period and the value at the end of the period, because the influence of the non-uniformity in density induced by the photoconductor drum 11 remains in the second light quantity correction data LD2 before tilt correction. Therefore, the tilt correction is made to raise the value at the end of the period. This ensures continuity between the start of the period and the end of the period in the second light quantity correction data LC2.

Figure 11:
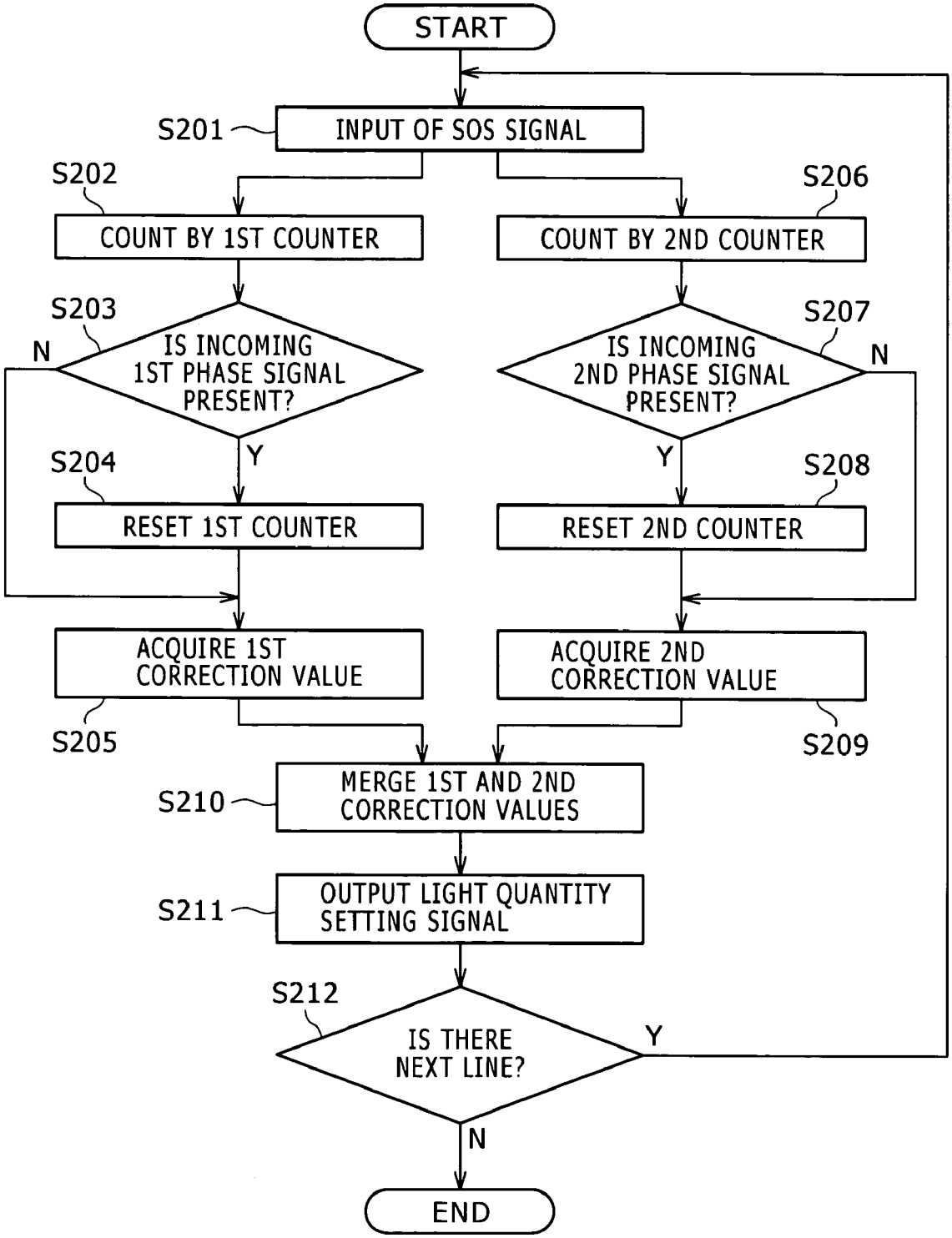
FIG. 11 is a flowchart to illustrate a process of setting a light quantity setting signal by the light quantity setting section.

Next, using the thus acquired first light quantity correction data LC1 and second light quantity correction data LC2, light quantity correction of the laser beam L that is performed during the image forming operation is described. FIG. 11 is a flowchart to illustrate a process of setting the light quantity setting signal by the above light quantity setting section 72.

At the onset of the image forming operation, when illumination with the laser beam L starts, an SOS signal SOS generated at this time is input to the light quantity setting section 72 (step 201).

The first counter 91 receives the input of the SOS signal SOS and increments the first count value by one (step 202). Then, the first counter 91 determines whether an incoming first phase signal PS1 is present (step 203). If an incoming first phase signal PS is present, the first count value of the first counter 91 is reset (step 204). Otherwise, if no incoming first phase signal PS is present, the process proceeds to the next step 205. The first correction section 92 refers to the first light-quantity correction data LC1 retrieved from the light quantity correction data storage section 88 in the correction setting section 71 and acquires a first correction value for the first count value incoming from the first counter 91 (step 205).

At the same time, in parallel with the above steps 202 to 205, the second counter 93 receives the input of the SOS signal SOS and increments the second count value by one (step 206). Then, the second counter 93 determines whether an incoming second phase signal PS2 is present (step 207). If an incoming second phase signal PS2 is present, the second count value of the second counter 93 is reset (step 208). Otherwise, if no incoming second phase signal PS2 is present, the process proceeds to the next step 209. The second correction section 94 refers to the second light quantity correction data LC2 retrieved from the light quantity correction data storage section 88 in the correction setting section 71 and acquires a second correction value for the second count value incoming from the second counter 93 (step 209).

Then, the merging section 95 adds the first correction value acquired in the step 205 and the second correction value acquired in the step 209, thus merging these values (step 210), and outputs the merged value as the light quantity setting signal SS to the exposure unit 13 (step 211). It is determine whether there is the next line (next fast-scan line) (step 212). If there is the next line, the process is continued, returning to the step 201. Otherwise, there is not the next line, a series of the process terminates.

Here, in the above step 205, the first correction value is acquired, for example, in the following manner. The first correction section 92 determines a position X in the slow-scan direction on the photoconductor drum 11 that is just coming to the illumination position (where the exposure unit 13 faces the photoconductor drum 11), based on the first count value acquired. Then, the first correction section 92 derives the light quantity correction value corresponding to the determined position X in the slow-scan direction from the first light quantity correction data LC1 shown in FIG. 9C and outputs this as the first correction value.

On the other hand, in the above step 209, the second correction value is acquired, for example, in the following manner. The second correction section 94 determines a position Y in the slow-scan direction on the developing sleeve 14*c*, when the position X in the slow-scan direction on the photoconductor drum 11 is just coming to the development position (where the photoconductor drum 11 faces the developing sleeve 14*c*), based on the second count value acquired. Then, the second correction section 92 derives the light quantity correction value corresponding to the determined position Y in the slow-scan direction from the second light quantity correction data LC2 shown in FIG. 10C and outputs this as the second correction value.

The merging section 95 adds the first correction value for the position X in the slow-scan direction on the photoconductor drum 11 that is passing the illumination position and the second correction value for the position Y in the slow-scan direction on the developing sleeve 14*c* facing the drum, when this position X in the slow-scan direction on the photoconductor drum 11 is passing the development position, and outputs the light quantity setting signal SS. In short, the light quantity setting signal SS is calculated and output line by line for the same line in the fast-scan direction.

Figure 12:
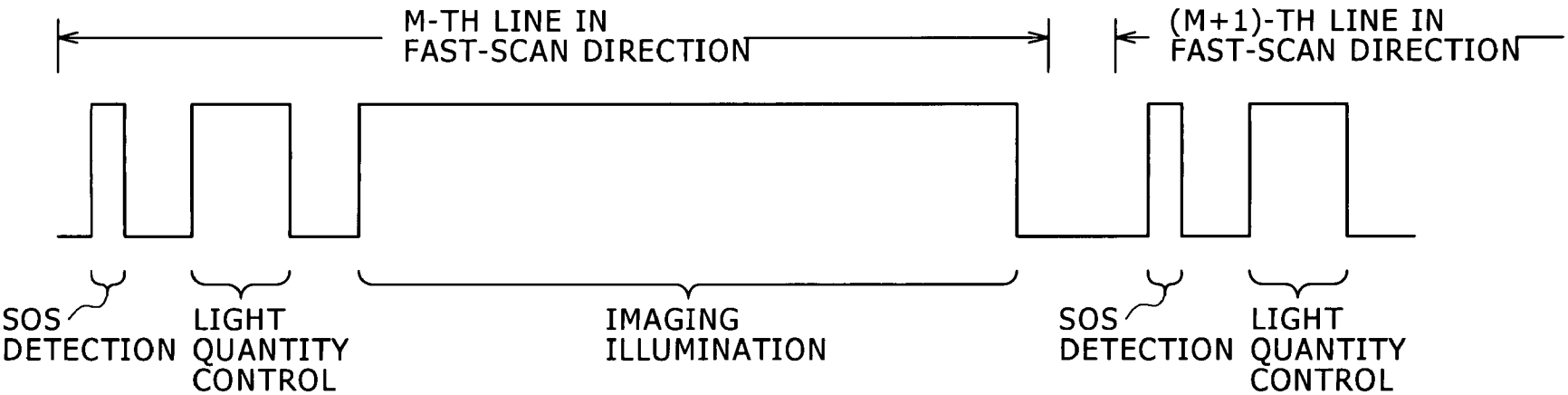
FIG. 12 is a timing chart to illustrate driving the light source (semiconductor laser) by the laser driver.

FIG. 12 is a timing chart to illustrate driving the light source 101 (semiconductor laser) by the laser driver shown in FIG. 2. FIG. 12 exemplifies the m-th line in the fast-scan direction and the (m+1)-th line in the fast-scan direction.

The laser driver 109 outputs a drive signal for SOS detection, a drive signal for light quantity control, and a drive signal for imaging illumination sequentially line by line in the fast-scan direction. When a drive signal for SOS detection is output, the laser beam L is output from the light source 101 and this beam is detected by the SOS sensor 108, thereby an SOS signal is output. This SOS signal is input via the laser driver 109 to the light quantity setting section 72 in the density correcting section 70. The light quantity setting section 72 performs the process illustrated in FIG. 11, thereby generating a light quantity setting signal SS. Then, the generated light quantity setting signal SS is input to the laser driver 109 in the exposure unit 13. The laser driver 109 outputs a drive signal for light quantity control whose output power has been adjusted according to the received light quantity setting signal SS, and laser beam L of an adjusted light quantity is output from the light source 101. Then, the laser driver 109 outputs a driver signal for imaging illumination, with the light quantity being adjusted by the light quantity setting signal SS. The light source 101 scans and illuminates the image formation area on the photoconductor drum 11 with the laser beam L of the adjusted light quantity to form an electrostatic latent image.

As above, in this exemplary embodiment, the first light quantity correction data LC1 and the second light quantity correction data LC2 for correcting the periodic density non-uniformities of the photoconductor drum 11 and the developing sleeve 14*c* are acquired beforehand. In actual image formation, the first correction value and the second correction value for the same line in the fast-scan direction, derived from these first light quantity correction data LC1 and second light quantity correction data LC2, are merged and the light quantity setting signal SS is generated. By this light quantity setting signal SS, the exposure unit 13 corrects the quantity of illuminating light to be output from it. Thereby, both non-uniformity in density occurring in synchronization with the first period T1 which is the rotation period of the photoconductor drum 11 and non-uniformity in density occurring in synchronization with the second period T2 which is the rotation period of the developing sleeve 14*c* can be suppressed by the adjustment of illuminating light quantity by the exposure unit 13.

In this exemplary embodiment, for example, when acquiring the first light quantity correction data LC1 for the photoconductor drum 11, the following are performed: synchronizing density data with the positions in the slow-scan direction on the photoconductor drum 11, separating this density data by each rotation period of the photoconductor drum 11, averaging the separated first density data pieces, density to light quantity conversion of the averaged first density data, and tilt correction. Thereby, more accurate first light quantity correction data LC1 can be obtained.

On the other hand, for example, when acquiring the second light quantity correction data LC2 for the developing sleeve 14*c*, the following are performed: synchronizing density data with the positions in the slow-scan direction on the developing sleeve 14*c*, separating this density data by each rotation period of the developing sleeve 14*c*, averaging the separated second density data pieces, density to light quantity conversion of the averaged second density data, and tilt correction. Thereby, more accurate second light quantity correction data LC2 can be obtained , as is the case for the first light quantity correction data LC1.

Here, in this exemplary embodiment, the first mark M1 is defined on the photoconductor drum 11 and, by reading this first mark M1 with the first phase sensor 17, the phase of the photoconductor drum 11 is detected. The second mark M2 is defined on the developing sleeve 14*c* as well and, by reading this second mark M2 with the second phase sensor 18, the phase of the developing sleeve 14*c* is detected. Thereby, synchronizing density data with the phase of the photoconductor drum 11 and the phase of the developing sleeve 14*c* can be performed easily.

Moreover, in this exemplary embodiment, the first correction value for the position X in the slow-scan direction on the photoconductor drum 11 that is passing the illumination position is derived from the first light quantity correction data LC1. The second correction value for the position Y in the slow-scan direction on the developing sleeve 14*c* facing the drum, when the position X in the slow-scan direction on the photoconductor drum 11 is passing the development position, is derived from the second light quantity correction data LC2. Using the light quantity setting signal SS obtained by merging these derived first and second correction values, light quantity correction is performed line by line in the fast-scan direction. In other words, the light quantity setting signal SS is obtained from the first and second correction values for the same line in the fast-scan direction. Thereby, an electrostatic latent image in accordance with the characteristics of the photoconductor drum 11 and the characteristics of the developing sleeve 14*c* is formed on the photoconductor drum 11. As a result, non-uniformity in density in a toner image developed can be suppressed.

In this exemplary embodiment, non-uniformity in density caused by the photoconductor drum 11 and the developing sleeve 14*c* is suppressed by adjusting the quantity of illuminating light of the exposure unit 13. Thus, the outside diameters and the like of the photoconductor drum 11 and the developing sleeve 14*c* can be set optionally. Consequently, design restrictions of the image forming apparatus are eased and the degree of freedom of design can be enhanced.

SECOND EXEMPLARY EMBODIMENT

A second exemplary embodiment which is primarily the same as the first exemplary embodiment is adapted such that frequency analysis is performed on density data obtained by reading an image for correction and ordering of submodules for which light quantity correction data is acquired is determined according to the result of this frequency analysis. In the second exemplary embodiment, the components corresponding to those in the first exemplary embodiment are assigned the same reference numbers and their detailed explanation is not repeated.

Figure 13:
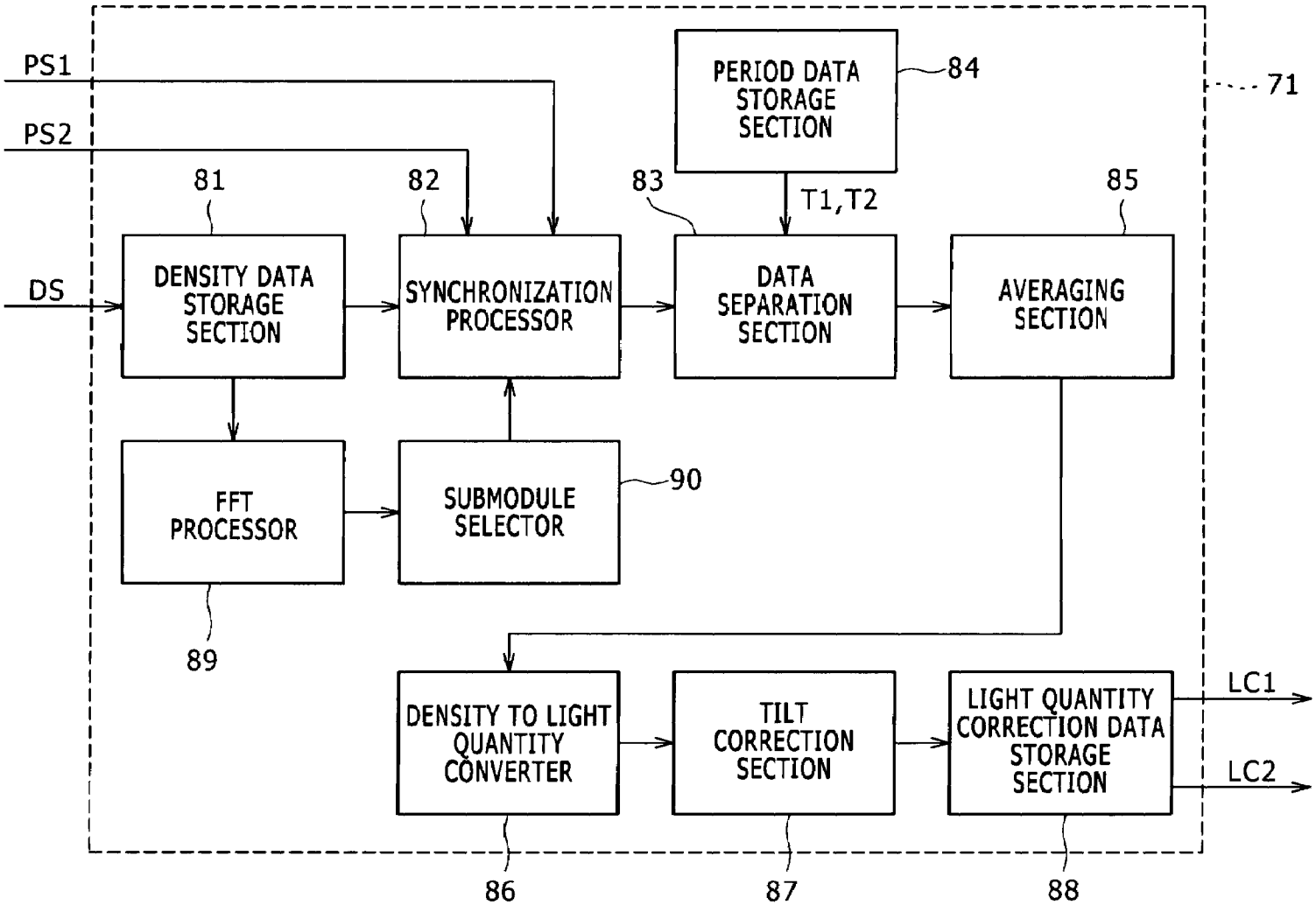
FIG. 13 is a diagram to illustrate a configuration of the correction setting section in accordance with a second exemplary embodiment.

FIG. 13 is a diagram to illustrate the configuration of the correction setting section 71 for use in the second exemplary embodiment. This correction setting section 71 is the same in the basic configuration as that for the first exemplary embodiment, but is somewhat different, as it further includes a FFT processor 89 and a submodule selector 90.

The FFT processor 89 as a Fast Fourier Transform processor performs Fast Fourier Transform (FFT) on density data retrieved from the density data storage section 81. The submodule selector 90 as a selector selects a submodule having a frequency with the largest amplitude out of the submodules regarded as the sources of inducing non-uniformity in density (the photoconductor drum 11 or the developing sleeve 14*c* in this example) based on the result of the FFT performed by the FFT processor 89 and outputs the result of the selection to the synchronization processor 82.

Figure 14:
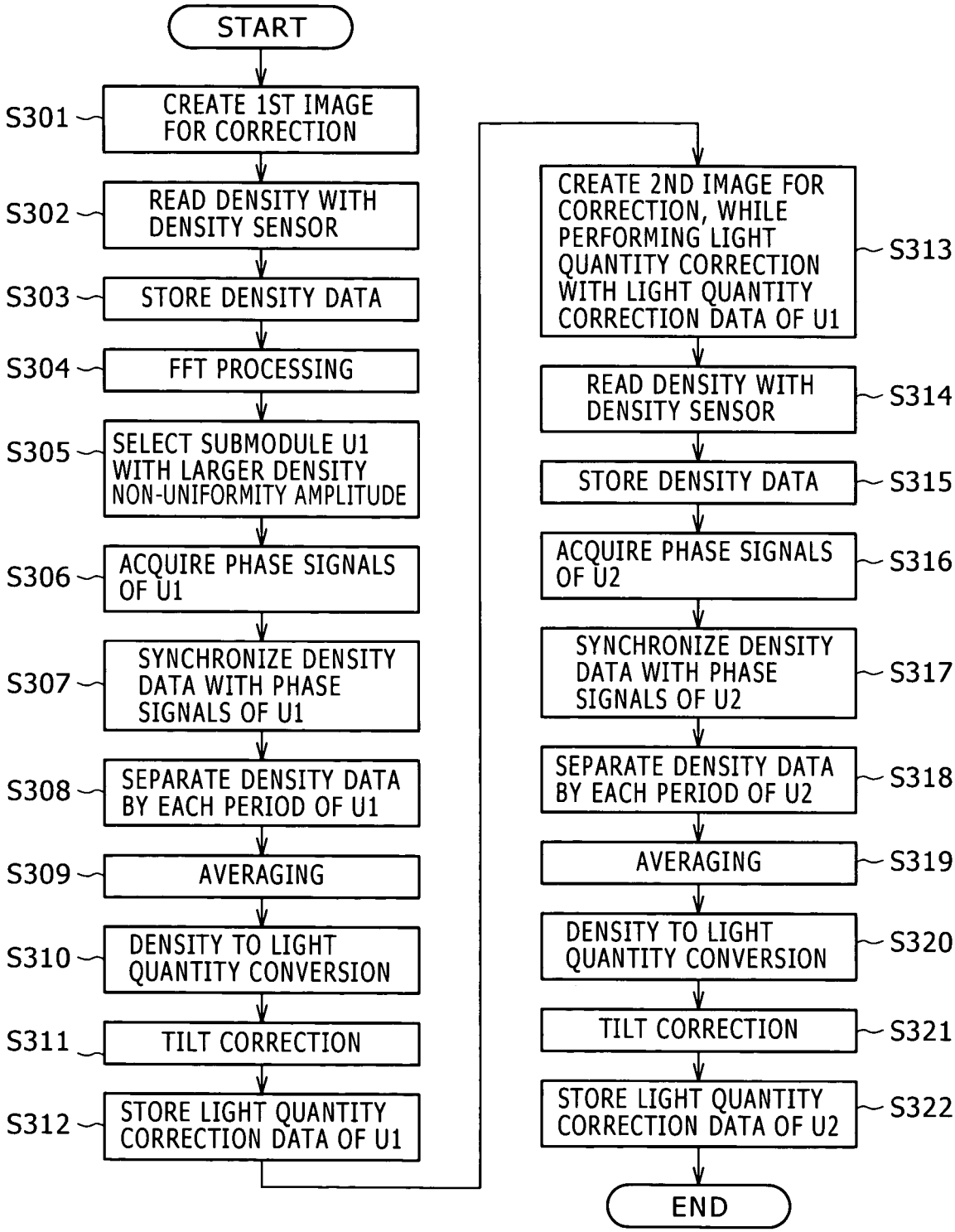
FIG. 14 is a flowchart to illustrate a process of acquiring plural data pieces for light quantity correction by the correction setting section in accordance with the second exemplary embodiment.

FIG. 14 is a flowchart to illustrate a process of acquiring plural data pieces for light quantity correction (in this exemplary embodiment, the first light quantity correction data LC1 for the photoconductor drum 11 and the second light quantity correction data LC2 for the developing sleeve 14*c*) by the foregoing correction setting section 71.

In this process, a first image for correction is first created by the image forming apparatus (step 301). Specifically, a toner image is formed on the intermediate transfer belt 20 by performing a series of charging, exposure, development, and first transfer. The thus created first image for correction is the same as for the first exemplary embodiment.

Next, the density of the toner image formed on the intermediate transfer belt 20 is read by the density sensor 28 (step 302) and detected density signals DS are output to the light quantity setting section 72. Upon receiving these signals, the light quantity setting section 72 stores the detected density signals DS as density data sequenced in the slow-scan direction into the light quantity correction data storage section 88 (step 303).

The FFT processor 89 then performs FFT processing on density data retrieved from the density data storage section 81 (step 304). Based on the result of the FFT processing, the submodule selector selects a submodule UI with a larger amplitude (either the photoconductor drum 11 or the developing sleeve 14*c* in this example) (step 305).

Next, the synchronization processor 82 acquires phase signals (first phase signals PS1 or second phase signals PS2) of the submodule U1 selected in the step 305 (step 306). The synchronization processor 82 associates and synchronizes density data which has been read from the density data storage section 81 with the acquired phase signals of the submodule U1 (step 307). The data separation section 83 separates density data for each period (first period T1 or second period T2) of the submodule U1 in plural rotations of the submodule U1 from phase-synchronized density data incoming from the synchronization processor 82 (step 308). Then, the averaging section 85 averages the plural density data pieces for each of the corresponding positions on the submodule U1 (step 309). The density to light quantity converter 86 makes conversion from density to light quantity for the density data averaged by the averaging section 85 (step 310). Then, the tilt correction section 87 makes tilt correction on the data subjected to the density to light quantity conversion (step 311) and outputs the result as light quantity correction data (first light quantity correction data LC1 or second light quantity correction data LC2) of the submodule U1. The light quantity correction data storage section 88 stores the incoming light quantity correction data of the submodule U1 (step 312).

Next, the image forming apparatus creates a second image for correction, while performing light quantity correction using the obtained light quantity correction data of the submodule U1 (step 313). The created second image for correction is the same as the first image for correction.

Next, the density of the toner image formed on the intermediate transfer belt 20 is read by the density sensor 28 (step 314) and detected density signals DS are output to the light quantity setting section 72. Upon receiving these signals, the light quantity setting section 72 stores the detected density signals DS as density data sequenced in the slow-scan direction into the light quantity correction data storage section 88 (step 315).

Next, the synchronization processor 82 acquires phase signals (first phase signals PS1 or second phase signals PS2) of a submodule U2 not selected in the step 305 (step 316). The synchronization processor 82 associates and synchronizes density data retrieved from the density data storage section 81 with the acquired phase signals of the submodule U2 (step 317). Then, the data separation section 83 separates density data for each period (first period T1 or second period T2) of the submodule U2 in plural rotations of the submodule U2 from the phase-synchronized density data incoming from the synchronization processor 82 (step 318). Then, the averaging section 85 averages the plural density data pieces for each of the corresponding positions on the submodule U2 (step 319). The density to light quantity converter 86 makes conversion from density to light quantity for the density data averaged by the averaging section 85 (step 320). The tilt correction section 87 makes tilt correction on the data subjected to the density to light quantity conversion (step 321) and outputs the result as light quantity correction data (first light quantity correction data LC1 or second light quantity correction data LC2) of the submodule U2. Then, the light quantity correction data storage section 88 stores the incoming light quantity correction data of the submodule U2 (step 322).

In the above step 302, in the case where density data, for example, as shown in FIG. 8A, is acquired, when the data is FFTed by the FFT processor 89, peaks appear in a first frequency corresponding to the first period T1 and a second frequency corresponding to the second period T2. In the example of FIG. 8A, because the amplitude of non-uniformity in density induced by the photoconductor drum 11 is larger than the amplitude of non-uniformity in density induced by the developing sleeve 14*c*, the peak value of the first frequency is larger than the second peak value. Therefore, in this example, the photoconductor drum 11 is selected as the submodule U1 and the developing sleeve 14*c* is selected as the submodule U2.

In addition to the same effects as the first exemplary embodiment, the second exemplary embodiment can provide the following effect. Light quantity correction data is obtained for each of the submodules of interest, based on submodule selection in descending order of density non-uniformity amplitude. While performing correction using light quantity correction data obtained for the first sub-module, light quantity correction data for the second sub-module can be obtained. Consequently, more accurate values of light quantity correction can be obtained. In this exemplary embodiment, it should be noted that light quantity correction data is first acquired for the submodule that has the largest density non-uniformity amplitude. Therefore, for example, when acquiring light quantity correction data for another module that has the second largest density non-uniformity amplitude, the influence of the submodule that has the largest density non-uniformity amplitude is already reduced and, thus, more accurate light quantity correction data can be obtained.

THIRD EXEMPLARY EMBODIMENT

A third exemplary embodiment which is primarily the same as the first exemplary embodiment is adapted such that light quantity correction data is first obtained for a submodule rotating in a shorter or the shortest period in which non-uniformity in density occurs. In this exemplary embodiment, the components corresponding to those in the first and second exemplary embodiments are assigned the same reference numbers and their detailed explanation is not repeated.

Figure 15:
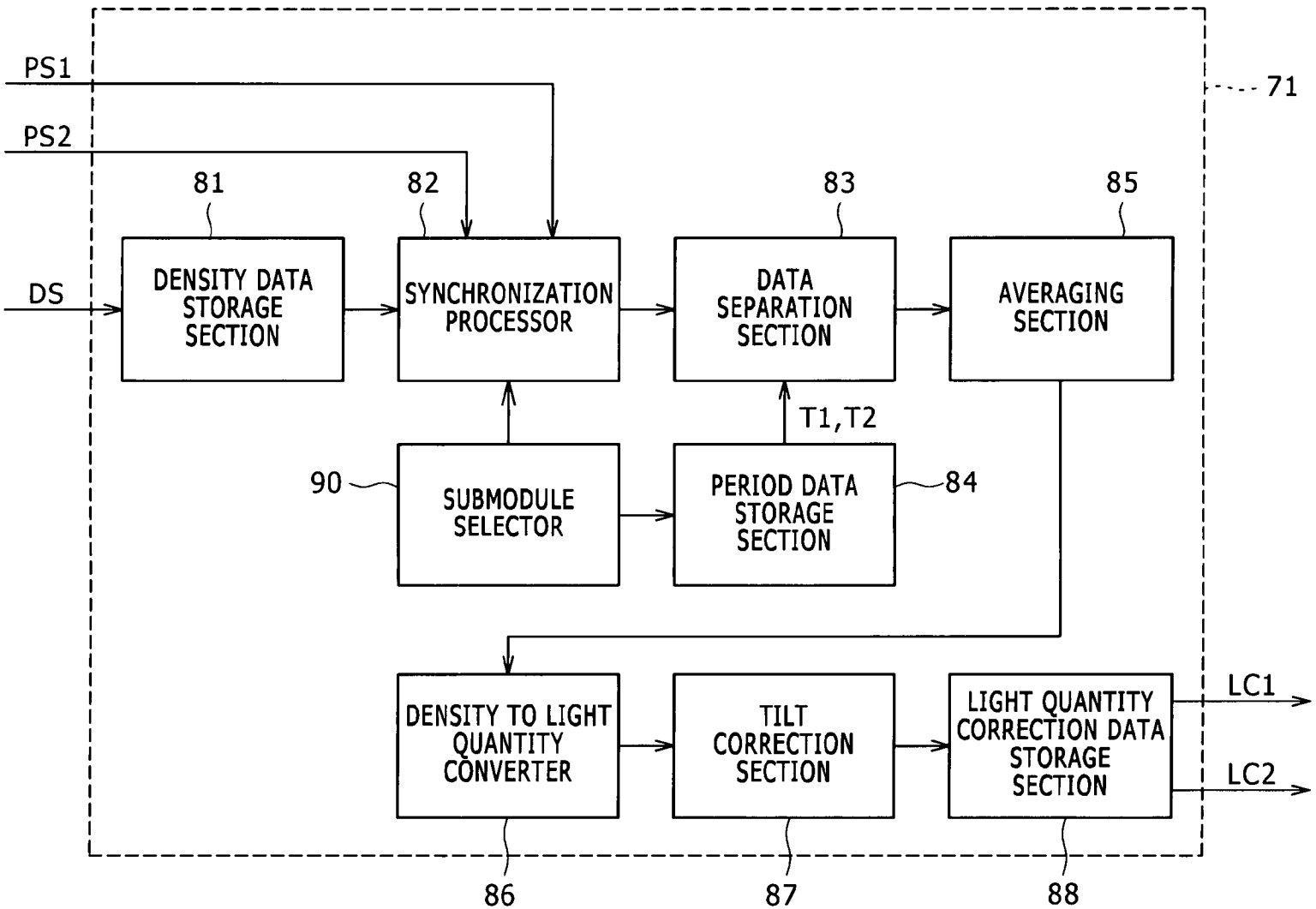
FIG. 15 is a diagram to illustrate a configuration of the correction setting section in accordance with a third exemplary embodiment.

FIG. 15 is a diagram to illustrate the configuration of the correction setting section 71 for use in the third exemplary embodiment. This correction setting section 71 is the same in the basic configuration as that for the first exemplary embodiment, but is somewhat different, as it further includes a submodule selector 90.

To this submodule selector 90, the first period T1 and the second period T2 are input from the period data storage section 84. The submodule selector 90 selects a submodule having the shortest one of the periods of the plural submodules input from the period data storage section 84, and outputs the selection result to the synchronization processor 82.

Figure 16:
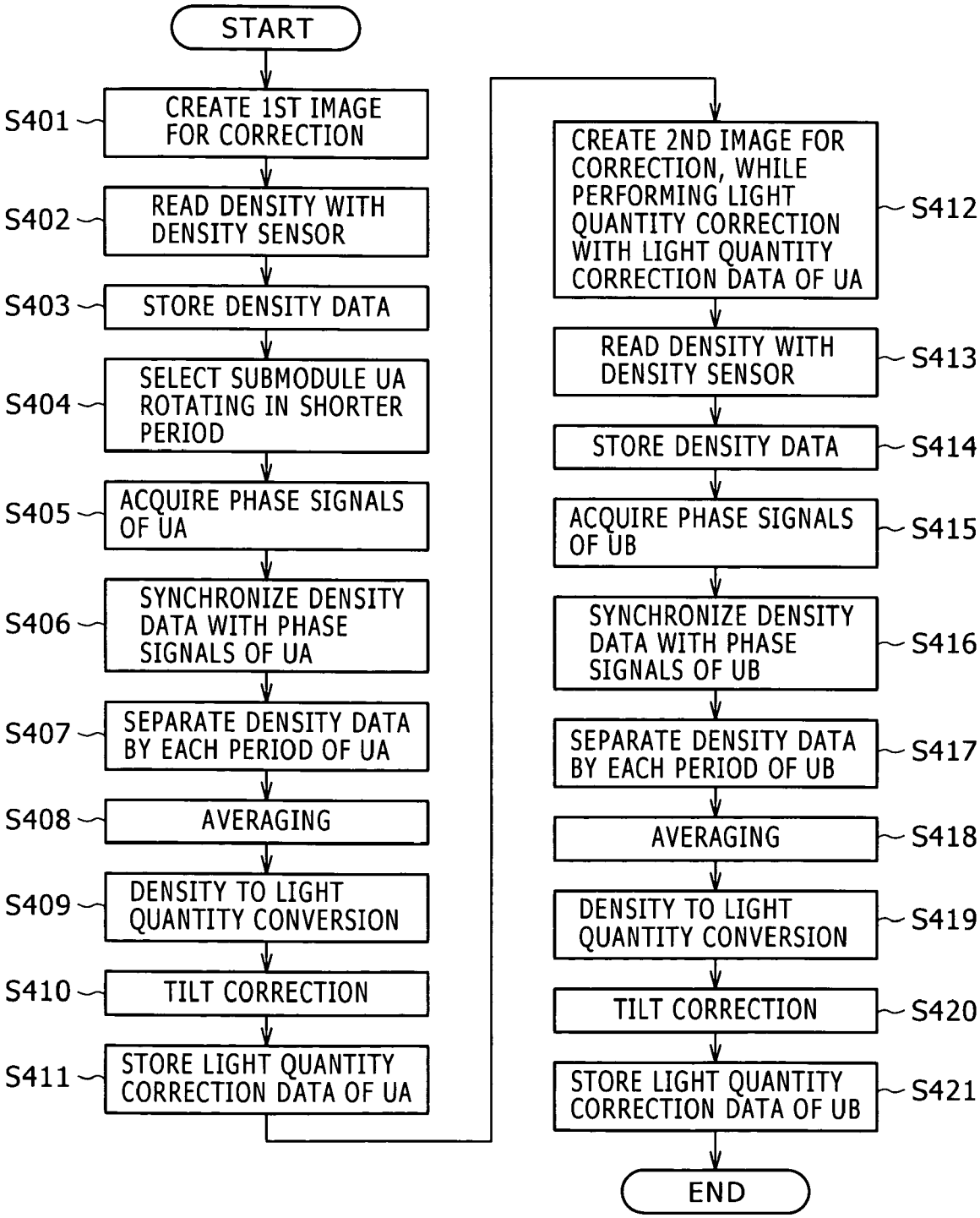
FIG. 16 is a flowchart to illustrate a process of acquiring plural data pieces for light quantity correction by the correction setting section in accordance with the third exemplary embodiment.

FIG. 16 is a flowchart to illustrate a process of acquiring plural data pieces for light quantity correction (in this exemplary embodiment, the first light quantity correction data LC1 for the photoconductor drum 11 and the second light quantity correction data LC2 for the developing sleeve 14*c*) by the foregoing correction setting section 71.

In this process, a first image for correction is first created by the image forming apparatus (step 401). Specifically, a toner image is formed on the intermediate transfer belt 20 by performing a series of charging, exposure, development, and first transfer. The thus created first image for correction is the same as for the first exemplary embodiment.

Next, the density of the toner image formed on the intermediate transfer belt 20 is read by the density sensor 28 (step 402) and detected density signals DS are output to the light quantity setting section 72. Upon receiving these signals, the light quantity setting section 72 stores the detected density signals DS as density data sequenced in the slow-scan direction into the light quantity correction data storage section 88 (step 403).

The submodule selector 90 selects a submodule US having a shorter period of rotation (either the photoconductor drum 11 or the developing sleeve 14*c* in this example), based on the first period T1 and the second period T2 incoming from the period data storage section 84 (step 404).

Next, the synchronization processor 82 acquires phase signals (first phase signals PS1 or second phase signals PS2) of the submodule UA selected in the step 404 (step 405). The synchronization processor 82. associates and synchronizes density data retrieved from the density data storage section 81 with the acquired phase signals of the submodule UA (step 406). Then, the data separation section 83 separates density data for each period (first period T1 or second period T2) of the submodule UA in plural rotations of the submodule UA from the phase-synchronized density data incoming from the synchronization processor 82 (step 407). Then, the averaging section 85 averages the plural density data pieces for each of the corresponding positions on the submodule UA (step 408). The density to light quantity converter 86 makes conversion from density to light quantity for the density data averaged by the averaging section 85 (step 409). The tilt correction section 87 makes tilt correction on the data subjected to the density to light quantity conversion (step 410), and outputs the result as light quantity correction data (first light quantity correction data LC1 or second light quantity correction data LC2) of the submodule UA. Then, the light quantity correction data storage section 88 stores the incoming light quantity correction data of the submodule UA (step 411).

Next, the image forming apparatus creates a second image for correction, while performing light quantity correction using the obtained light quantity correction data of the submodule UA (step 412). The created second image for correction is the same as the first image for correction.

Next, the density of the toner image formed on the intermediate transfer belt 20 is read by the density sensor 28 (step 413) and detected density signals DS are output to the light quantity setting section 72. Upon receiving these signals, the light quantity setting section 72 stores the detected density signals DS as density data sequenced in the slow-scan direction into the light quantity correction data storage section 88 (step 414).

Next, the synchronization processor 82 acquires phase signals (first phase signals PS1 or second phase signals PS2) of a submodule UB not selected in the step 404 (step 415). The synchronization processor 82 associates and synchronizes density data retrieved from the density data storage section 81 with the acquired phase signals of the submodule UB (step 416). Then, the data separation section 83 separates density data for each period (first period T1 or second period T2) of the submodule UB in plural rotations of the submodule UB from the phase-synchronized density data incoming from the synchronization processor 82 (step 417). Then, the averaging section 85 averages the plural density data pieces for each of the corresponding positions on the submodule UB (step 418). The density to light quantity converter 86 makes conversion from density to light quantity for the density data averaged by the averaging section 85 (step 419). The tilt correction section 87 makes tilt correction on the data subjected to the density to light quantity conversion (step 420), and outputs the result as light quantity correction data (first light quantity correction data LC1 or second light quantity correction data LC2) of the submodule UB. Then, the light quantity correction data storage section 88 stores the incoming light quantity correction data of the submodule UB (step 421).

As described above, in addition to the same effects as the first exemplary embodiment, the third exemplary embodiment can provide the following effect. The density data obtained by reading the first created image for correction includes density non-uniformity components induced by plural submodules (the photoconductor drum 11 and the developing sleeve 14*c* herein). To detect density non-uniformities of a submodule of interest for correction, it is needed to read density data for plural rotations of the submodule. If a submodule rotating in a shorter period is first selected, it is possible to shorten the length of the first image for correction in the slow-scan direction and reduce the toner amount to be consumed for forming the image for correction. In the case of the third exemplary embodiment, there is no need to perform frequency analysis which is involved in the second exemplary embodiment. Thus, the circuit for FFT processing is not necessary and the circuit configuration of the correction setting section 71 can be simplified. In consequence, this exemplary embodiment provides the benefit that required cost can be reduced.

In the first through third exemplary embodiments, correcting the non-uniformity in density caused by the photoconductor drum 11 and the non-uniformity in density caused by the developing sleeve 14*c* has been discussed; however, correction is not limited to these submodules. Other submodules can be targeted for correction and such submodules include, for example, the charging roller 12, the first transfer roller 15, and may include the rotary polygon mirror 104 provided in the exposure unit 13. In the described exemplary embodiments, suppressing non-uniformity in density caused by two submodules, namely, the photoconductor drum 11 and the developing sleeve 14*c* has been discussed, but is not limited to these submodules. For submodules more than two, non-uniformity in density occurring can be suppressed through the same control manner as explained above.

In the first through third exemplary embodiments, density control is performed by adjusting the light quantity emitted from the light source 101 in the exposure unit 13. Not limited to this, density control may be performed by, for example, adjusting the voltage of a charging bias that is applied to the charging roller 12. Alternatively, the density of an image to be formed can be controlled by, for example, adjusting the voltage of a developing bias that is applied to the developing roller 14*a* or the voltage of a first transfer bias that is applied to the first transfer roller 15. Additionally, for example, adjustment may be made on image data to write that is output from the IPS 60. Furthermore, the exposure unit 13 in use in the apparatus does not necessarily have to employ the semiconductor laser, but can employ, for example, an array of plural LEDs arranged in the fast-scan direction.

In the first through third exemplary embodiments, by way of example, the implementations of the invention in a so-called tandem type color image forming apparatus have been discussed. Not limited to this, the invention can be applied to color image forming apparatus and monochrome (plain color) image forming apparatus utilizing other schemes.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus comprising:

a first submodule that is used for image formation;

a first phase detector that detects a phase of the first submodule;

a second submodule that is used for image formation in conjunction with the first submodule;

a second phase detector that detects a phase of the second submodule;

a density detector that detects density of an image formed by using the first submodule and the second submodule;

a correction setting section that sets a first parameter to correct non-uniformity in density in a slow-scan direction caused by the first submodule and a second parameter to correct non-uniformity in density in the slow-scan direction caused by the second submodule, based on image density data detected by the density detector;

an output setting section that derives a first correction value for the phase of the first submodule detected by the first phase detector from the first parameter set by the correction setting section, derives a second correction value for the phase of the second submodule detected by the second phase detector from the second parameter set by the correction setting section, and outputs a correction value generated by merging the first correction value and the second correction value; and an imaging condition changing section that changes imaging conditions in accordance with the correction value which is output by the output setting section.

2. The image forming apparatus according to claim 1, further comprising:

a selector that selects a submodule having a larger amplitude of non-uniformity in density out of the first submodule and the second submodule, based on the image density data detected by the density detector, wherein the correction setting section performs parameter setting operation starting with the submodule selected by the selector.

3. The image forming apparatus according to claim 2, further comprising:

a Fast Fourier Transform processor that performs Fast Fourier Transform on the image density data detected by the density detector, wherein the selector selects a submodule having a larger amplitude of non-uniformity in density, based on results of Fast Fourier Transform performed on the density data by the Fast Fourier Transform processor.

4. The image forming apparatus according to claim 1, further comprising:

a selector that selects a submodule having a shorter period of rotation in which non-uniformity in density occurs out of the first submodule and the second submodule, based on the image density data detected by the density detector, wherein the correction setting section performs parameter setting operation starting with the submodule selected by the selector.

5. The image forming apparatus according to claim 1, wherein the first submodule is a photoconductor having a photoconductive layer; and the second module is a developing roll that develops an electrostatic latent image on the photoconductor with toner.

6. The image forming apparatus according to claim 5, further comprising:

a charging unit that charges the photoconductor at a predetermined potential; and an exposure unit that selectively illuminates the photoconductor charged by the charging unit to form an electrostatic latent image, wherein the imaging condition changing section changes a light quantity that is output from the exposure unit in accordance with the correction value.

7. A correction parameter setting device that is used in an image forming apparatus provided with a plurality of submodules including a first submodule and a second submodule, and sets correction parameters for correcting non-uniformity in density in a slow-scan direction, the device comprising:

a first phase detector that detects a phase of the first submodule;

a second phase detector that detects a phase of the second submodule;

a density detector that detects density of an image formed by using the first submodule and the second submodule; and a correction setting section that sets a first parameter to correct non-uniformity in density in the slow-scan direction caused by the first submodule, while associating image density data detected by the density detector with the phase of the first module detected by the first phase detector, and sets a second parameter to correct non-uniformity in density in the slow-scan direction caused by the second submodule, while associating the image density data detected by the density detector with the phase of the second submodule detected by the second phase detector.

8. The correction parameter setting device according to claim 7, wherein the correction setting section comprises:

a synchronization processor that synchronizes the density data with the phase of the first submodule detected by the first phase detector;

a data separation section that separates the density data synchronized with the phase of the first submodule for each rotation period of the first submodule;

an averaging section that averages a plurality of separated density data pieces for each of corresponding positions;

a converter that converts the averaged density data into light quantity data; and a tilt correction section that corrects a tilt of the light quantity data resulted from the conversion to acquire the first parameter.

9. The correction parameter setting device according to claim 8, wherein the correction setting section comprises:

a synchronization processor that synchronizes the density data with the phase of the second submodule detected by the second phase detector;

a data separation section that separates the density data synchronized with the phase of the second submodule for each rotation period of the second submodule;

an averaging section that averages a plurality of separated density data pieces for each of corresponding positions;

a converter that converts the averaged density data into light quantity data; and a tilt correction section that corrects a tilt of the light quantity data resulted from the conversion to acquire the second parameter.

10. The correction parameter setting device according to claim 7, further comprising:

a selector that selects a submodule having a larger amplitude of non-uniformity in density out of the first submodule and the second submodule, based on the image density data detected by the density detector, wherein the correction setting section performs parameter setting operation starting with the submodule selected by the selector.

11. The correction parameter setting device according to claim 7, further comprising:

a selector that selects a submodule having a shorter period of rotation in which non-uniformity in density occurs out of the first submodule and the second submodule, based on the image density data detected by the density detector, wherein the correction setting section performs parameter setting operation starting with the submodule selected by the selector.

12. The correction parameter setting device according to claim 7, wherein the correction setting section sets the first parameter based on the density data of an image formed by using the first submodule and the second submodule; and sets the second parameter based on the density data of another image formed by using the first submodule and the second submodule, wherein the density of the another image has been corrected by the first parameter.

13. The correction parameter setting device according to claim 7, wherein the first submodule is a photoconductor having a photoconductive layer; and the second module is a developer carrying body that develops an electrostatic latent image on the photoconductor with toner.

14. A density non-uniformity correction device that is used in an image forming apparatus provided with a plurality of submodules including a first submodule, a second submodule, and a third submodule, and corrects non-uniformity in density in the slow-scan direction, the device comprising:

a first phase detector that detects a phase of the first submodule;

a second phase detector that detects a phase of the second submodule;

a correction data storage section that stores first density correction data for the first submodule and second density correction data for the second submodule;

a first correction section that derives a first correction value for the phase of the first submodule detected by the first phase detector from the first density correction data retrieved from the correction data storage section;

a second correction section that derives a second correction value for the phase of the second submodule detected by the second phase detector from the second density correction data retrieved from the correction data storage section; and a merging section that merges the first correction value derived by the first correction section and the second correction value derived by the second correction section and outputs a merged correction value to the third submodule.

15. The density non-uniformity correction device according to claim 14, wherein the first density correction data which is stored into the correction data storage section is set so as to be associated with a period of rotation of the first submodule and the second density correction data which is stored in the correction data storage section is set so as to be associated with a period of rotation of the second submodule.

16. The density non-uniformity correction device according to claim 14, wherein the merging section merges the first correction value and the second correction value for the same line in a fast-scan direction, thus generating the merged correction value.

17. The density non-uniformity correction device according to claim 14, wherein the first submodule is a photoconductor having a photoconductive layer;

the second module is a developer carrying body that develops an electrostatic latent image on the photoconductor with toner; and the third submodule is an exposure unit that selectively illuminates the charged photoconductor to form the electrostatic latent image.

18. The density non-uniformity correction device according to claim 17, wherein the first correction section derives a first correction value corresponding to a position in the slow-scan direction on the photoconductor, the position being just coming to an illumination position by the exposure unit; and the second correction section derives a second correction value corresponding to a position in the slow-scan direction on the developer carrying body, the position being just coming to a development position by the developer carrying body, when the illumination position on the photoconductor is just coming to the development position.

19. The density non-uniformity correction device according to claim 17, wherein the merging section merges light quantity correction signals and outputs a merged signal as the correction value to the exposure unit line by line in the fast-scan direction.

* * * * *